US010670302B2

(12) United States Patent
Hazzard et al.

(10) Patent No.: US 10,670,302 B2
(45) Date of Patent: Jun. 2, 2020

(54) PILOT LIGHT CONTROL FOR AN APPLIANCE

(71) Applicant: Ademco Inc., Golden Valley, MN (US)

(72) Inventors: Frederick Hazzard, Plymouth, MN (US); David Heil, Robbinsdale, MN (US); Ravindra Khosla, Maple Grove, MN (US)

(73) Assignee: Ademco Inc., Golden Valley, MN (US)

( * ) Notice: Subject to any disclaimer, the term of this patent is extended or adjusted under 35 U.S.C. 154(b) by 484 days.

(21) Appl. No.: 14/225,282

(22) Filed: Mar. 25, 2014

(65) Prior Publication Data

US 2015/0276268 A1 Oct. 1, 2015

(51) Int. Cl.

| | |
|---|---|
| ***F24H 9/20*** | (2006.01) |
| ***F24H 1/18*** | (2006.01) |
| ***F23N 5/24*** | (2006.01) |

(52) U.S. Cl.

CPC ..... *F24H 9/2035* (2013.01); *F23N 5/242* (2013.01); *F24H 1/186* (2013.01); *F23N 2227/30* (2020.01); *F23N 2241/04* (2020.01)

(58) Field of Classification Search

CPC .. F23N 2027/30; F23N 2041/04; F23N 5/242; F24H 1/186; F24H 9/2035

See application file for complete search history.

(56) References Cited

U.S. PATENT DOCUMENTS

| | | | | |
|---|---|---|---|---|
| 2,331,718 A | | 10/1943 | Newton | |
| 2,920,126 A | | 1/1960 | Hajny | |
| 3,272,432 A | | 9/1966 | Davidson | |
| 3,727,073 A | * | 4/1973 | Cade | F23N 5/123 307/117 |
| 3,759,279 A | | 9/1973 | Smith, Jr. | |
| 3,833,428 A | | 9/1974 | Snyder et al. | |
| 3,847,350 A | | 11/1974 | Thompson | |

(Continued)

FOREIGN PATENT DOCUMENTS

| | | |
|---|---|---|
| CA | 2158120 | 3/1997 |
| CN | 201772614 | 3/2011 |

(Continued)

OTHER PUBLICATIONS

Gulherme, "Hot water alarm", Sep. 4, 2002, Halfbakery.com.*

(Continued)

*Primary Examiner* — Jorge A Pereiro
*Assistant Examiner* — Logan P Jones
(74) *Attorney, Agent, or Firm* — Shumaker & Sieffert, P.A.

(57) ABSTRACT

A device for igniting a pilot light for a heating appliance or for re-igniting the pilot. The device may monitor a thermopile at the pilot to determine if the pilot is lit and, if not, attempt to relight it. If the device fails to relight the pilot, it may continue attempting to relight the pilot until the stored energy is nearly depleted. Before the stored energy is depleted, the device may send a message indicating a failure to relight. The last of stored energy may alert a homeowner with an alarm that the appliance control has shut down and the pilot could not be relit. If the amount of energy stored drops below a specified threshold and the device successfully lights the pilot, it may restore the control to normal operation, and replenish the stored energy. The device may do a standing pilot or an intermittent pilot.

18 Claims, 29 Drawing Sheets

(56) References Cited

U.S. PATENT DOCUMENTS 3,849,350 A 11/1974 Matsko
3,909,816 A 9/1975 Teeters
3,948,439 A 4/1976 Heeger
4,127,380 A * 11/1978 Straitz, III ..... F23Q 9/08 431/15
4,131,413 A * 12/1978 Ryno ..... F23N 5/105 431/44
4,221,557 A 9/1980 Jalics
4,305,547 A 12/1981 Cohen
4,324,207 A 4/1982 Leuthard
4,324,944 A 4/1982 Weihrich et al.
RE30,936 E 5/1982 Kmetz et al.
4,333,002 A 6/1982 Kozak
4,421,062 A 12/1983 Padilla, Sr.
4,438,728 A 3/1984 Fracaro
4,467,178 A 8/1984 Swindle
4,483,672 A 11/1984 Wallace et al.
4,507,938 A 4/1985 Hama et al.
4,508,261 A 4/1985 Blank
4,511,790 A 4/1985 Kozak
4,568,821 A 2/1986 Boe
4,588,875 A 5/1986 Kozak et al.
4,638,789 A 1/1987 Ueki et al.
4,655,705 A 4/1987 Shute et al.
4,692,598 A 9/1987 Yoshida et al.
4,696,639 A 9/1987 Bohan, Jr.
4,734,658 A 3/1988 Bohan, Jr.
4,742,210 A 5/1988 Tsuchiyama et al.
4,770,629 A 9/1988 Bohan, Jr.
4,778,378 A * 10/1988 Dolnick ..... F23N 5/082 136/253
4,794,599 A * 12/1988 Purcell ..... G01R 31/31915 714/719
4,830,601 A 5/1989 Dahlander et al.
4,834,284 A 5/1989 Vandermeyden
4,906,337 A 3/1990 Palmer
4,965,232 A 10/1990 Mauleon et al.
4,977,885 A 12/1990 Herweyer et al.
4,984,981 A 1/1991 Pottebaum
4,986,468 A 1/1991 Deisinger
5,007,156 A 4/1991 Hurtgen
5,037,291 A 8/1991 Clark
5,077,550 A 12/1991 Cormier
5,103,078 A 4/1992 Boykin et al.
5,112,217 A 5/1992 Ripka et al.
5,125,068 A 6/1992 McNair et al.
5,126,721 A 6/1992 Butcher et al.
5,222,888 A 6/1993 Jones et al.
5,232,582 A 8/1993 Takahashi et al.
5,236,328 A 8/1993 Tate et al.
5,280,802 A 1/1994 Comuzie, Jr.
5,317,670 A 5/1994 Elia
5,391,074 A 2/1995 Meeker
5,424,554 A 6/1995 Marran et al.
5,442,157 A 8/1995 Jackson
5,567,143 A 10/1996 Servidio
5,622,200 A 4/1997 Schulze
5,660,328 A 8/1997 Momber
5,779,143 A 7/1998 Michaud et al.
5,791,890 A * 8/1998 Maughan ..... F24C 3/128 126/19 R
5,797,358 A * 8/1998 Brandt ..... F24H 9/2035 122/448.1
5,857,845 A 1/1999 Paciorek
5,896,089 A 4/1999 Bowles
5,968,393 A 10/1999 Demaline
5,971,745 A 10/1999 Bassett et al.
5,975,884 A 11/1999 Dugger
6,053,130 A 4/2000 Shellenberger
6,059,195 A 5/2000 Adams et al.
6,069,998 A 5/2000 Barnes et al.
6,075,923 A 6/2000 Wu
6,080,971 A 6/2000 Seitz et al.
6,208,806 B1 3/2001 Langford
6,212,894 B1 4/2001 Brown et al.
6,236,321 B1 5/2001 Troost, IV
6,261,087 B1 * 7/2001 Bird ..... F23N 5/102 126/512
6,271,505 B1 8/2001 Henderson
6,286,464 B1 9/2001 Abraham et al.
6,293,471 B1 9/2001 Stettin et al.
6,299,433 B1 10/2001 Gauba et al.
6,350,967 B1 2/2002 Scott
6,351,603 B2 2/2002 Waithe et al.
6,363,218 B1 3/2002 Lowenstein et al.
6,371,057 B1 4/2002 Henderson
6,375,087 B1 4/2002 Day et al.
6,390,029 B2 5/2002 Alphs
RE37,745 E 6/2002 Brandt et al.
6,410,842 B1 * 6/2002 McAlonan ..... H01L 35/00 136/242
6,455,820 B2 9/2002 Bradenbaugh
6,548,987 B1 * 4/2003 Oster ..... H04R 1/08 320/114
6,553,946 B1 4/2003 Abraham et al.
6,560,409 B2 5/2003 Troost, IV
6,606,968 B2 8/2003 Iwamam et al.
6,629,021 B2 9/2003 Cline et al.
6,631,622 B1 10/2003 Ghent et al.
6,633,726 B2 10/2003 Bradenbaugh
6,684,821 B2 2/2004 Lannes et al.
6,701,874 B1 3/2004 Schultz et al.
6,732,677 B2 5/2004 Donnelly et al.
6,794,771 B2 9/2004 Orloff
6,795,644 B2 9/2004 Bradenbaugh
6,835,307 B2 12/2004 Talbert et al.
6,845,110 B2 1/2005 Gibson
6,861,621 B2 3/2005 Ghent
6,880,493 B2 4/2005 Clifford
6,920,377 B2 * 7/2005 Chian ..... F24H 9/2035 236/1 A
6,934,862 B2 8/2005 Sharood et al.
6,936,798 B2 8/2005 Moreno
6,955,301 B2 10/2005 Munsterhuis et al.
6,959,876 B2 11/2005 Chian et al.
6,967,565 B2 11/2005 Lingemann
6,973,819 B2 12/2005 Ruhland et al.
6,995,301 B1 2/2006 Shorrosh
7,032,542 B2 4/2006 Donnelly et al.
7,065,431 B2 6/2006 Patterson et al.
7,076,373 B1 7/2006 Munsterhuis et al.
7,088,238 B2 8/2006 Karaoguz et al.
7,103,272 B2 9/2006 Baxter
7,117,825 B2 10/2006 Phillips
7,137,373 B2 11/2006 Seymour, II et al.
7,162,150 B1 1/2007 Welch et al.
7,167,813 B2 1/2007 Chian et al.
7,221,862 B1 5/2007 Miller et al.
7,252,502 B2 8/2007 Munsterhuis
7,255,285 B2 8/2007 Troost et al.
7,298,968 B1 11/2007 Boros et al.
7,317,265 B2 1/2008 Chian et al.
7,346,274 B2 3/2008 Bradenbaugh
7,373,080 B2 5/2008 Baxter
7,380,522 B2 6/2008 Krell et al.
7,432,477 B2 10/2008 Teti
7,434,544 B2 10/2008 Donnelly et al.
7,469,550 B2 12/2008 Chapman, Jr. et al.
7,506,617 B2 3/2009 Paine
7,526,539 B1 4/2009 Hsu
7,561,057 B2 7/2009 Kates
7,603,204 B2 10/2009 Patterson et al.
7,613,855 B2 11/2009 Phillips et al.
7,623,771 B2 11/2009 Lentz et al.
7,634,976 B2 12/2009 Gordon et al.
7,672,751 B2 3/2010 Patterson et al.
7,712,677 B1 5/2010 Munsterhuis et al.
7,744,007 B2 6/2010 Beagen et al.
7,744,008 B2 6/2010 Chapman, Jr. et al.
7,770,807 B2 8/2010 Robinson et al.
7,798,107 B2 9/2010 Chian et al.
7,804,047 B2 9/2010 Zak et al.
7,902,959 B2 3/2011 Yamada et al.

(56) References Cited

U.S. PATENT DOCUMENTS

| | | | | |
|---|---|---|---|---|
| 7,932,480 | B2 | 4/2011 | Gu et al. | |
| 7,934,662 | B1 | 5/2011 | Jenkins | |
| 7,970,494 | B2 | 6/2011 | Fima | |
| 7,974,527 | B1 | 7/2011 | Adler | |
| 8,061,308 | B2 | 11/2011 | Phillips | |
| 8,074,894 | B2 | 12/2011 | Beagen | |
| 8,083,104 | B2 | 12/2011 | Roetker et al. | |
| 8,111,980 | B2 | 2/2012 | Bradenbaugh | |
| 8,165,726 | B2 | 4/2012 | Nordberg et al. | |
| 8,204,633 | B2 | 6/2012 | Harbin, III et al. | |
| 8,245,987 | B2 | 8/2012 | Hazzard et al. | |
| 8,322,312 | B2 | 12/2012 | Strand | |
| 8,367,984 | B2 | 2/2013 | Besore | |
| 8,422,870 | B2 | 4/2013 | Nelson et al. | |
| 8,485,138 | B2 | 7/2013 | Leeland et al. | |
| 8,600,556 | B2 | 12/2013 | Nesler et al. | |
| 8,606,092 | B2 | 12/2013 | Amiran et al. | |
| 8,660,701 | B2 | 2/2014 | Phillips et al. | |
| 8,726,789 | B2 | 5/2014 | Clark | |
| 8,770,152 | B2 | 7/2014 | Leeland et al. | |
| 9,080,769 | B2 * | 7/2015 | Bronson | F24H 1/205 |
| 9,122,283 | B2 | 9/2015 | Rylski et al. | |
| 9,249,986 | B2 | 2/2016 | Hazzard et al. | |
| 9,268,342 | B2 | 2/2016 | Beyerle et al. | |
| 9,310,098 | B2 | 4/2016 | Buescher et al. | |
| 9,423,050 | B2 * | 8/2016 | Anderson | |
| 2002/0099474 | A1 | 7/2002 | Khesin | |
| 2003/0093186 | A1 | 5/2003 | Patterson et al. | |
| 2004/0042772 | A1 | 3/2004 | Whitford et al. | |
| 2004/0079749 | A1 | 4/2004 | Young et al. | |
| 2006/0027571 | A1 | 2/2006 | Miyoshi et al. | |
| 2006/0272830 | A1 | 12/2006 | Fima | |
| 2007/0023333 | A1 | 2/2007 | Mouhebaty et al. | |
| 2007/0210177 | A1 | 9/2007 | Karasek | |
| 2007/0281257 | A1 * | 12/2007 | Hughes | F23N 5/102 431/22 |
| 2007/0292810 | A1 | 12/2007 | Maiello et al. | |
| 2008/0003530 | A1 * | 1/2008 | Donnelly | F23N 5/242 431/22 |
| 2008/0023564 | A1 | 1/2008 | Hall | |
| 2008/0048046 | A1 | 2/2008 | Wagner et al. | |
| 2008/0059080 | A1 * | 3/2008 | Greiner | H04L 41/0681 702/33 |
| 2008/0188995 | A1 | 8/2008 | Hotton et al. | |
| 2008/0197206 | A1 | 8/2008 | Murakami et al. | |
| 2009/0117503 | A1 | 5/2009 | Cain | |
| 2010/0065764 | A1 | 3/2010 | Canpolat | |
| 2010/0073197 | A1 * | 3/2010 | Eagleton | G07C 5/008 340/945 |
| 2010/0163016 | A1 | 7/2010 | Pan | |
| 2011/0031323 | A1 | 2/2011 | Nold et al. | |
| 2011/0123179 | A1 | 5/2011 | Roetker et al. | |
| 2011/0254661 | A1 | 10/2011 | Fawcett et al. | |
| 2011/0259322 | A1 | 10/2011 | Davis et al. | |
| 2011/0305444 | A1 | 12/2011 | Pussell | |
| 2012/0023212 | A1 | 1/2012 | Roth et al. | |
| 2012/0060771 | A1 | 3/2012 | Brian et al. | |
| 2012/0060829 | A1 | 3/2012 | DuPlessis et al. | |
| 2012/0167869 | A1 * | 7/2012 | Huang | F24C 3/00 126/39 BA |
| 2012/0271465 | A1 | 10/2012 | Zobrist et al. | |
| 2013/0104814 | A1 * | 5/2013 | Reyman | F23N 5/242 122/14.21 |
| 2014/0060457 | A1 | 3/2014 | Hill et al. | |
| 2014/0202549 | A1 | 7/2014 | Hazzard et al. | |
| 2014/0203093 | A1 | 7/2014 | Young et al. | |
| 2014/0212821 | A1 * | 7/2014 | Banu | F23N 5/242 431/6 |
| 2015/0083384 | A1 | 3/2015 | Lewis, Jr. et al. | |
| 2015/0120067 | A1 | 4/2015 | Wing et al. | |
| 2015/0148971 | A1 | 5/2015 | Acker | |
| 2015/0276265 | A1 * | 10/2015 | Davari | H04L 67/025 700/300 |
| 2015/0354833 | A1 | 12/2015 | Kreutzman | |

FOREIGN PATENT DOCUMENTS

| | | | |
|---|---|---|---|
| CN | 201909441 | | 7/2011 |
| CN | 102213489 | | 10/2011 |
| CN | 203203717 | | 9/2013 |
| EP | 0356609 | | 3/1990 |
| EP | 0531072 | | 3/1993 |
| EP | 0699316 | | 7/1999 |
| EP | 0967440 | A2 | 12/1999 |
| EP | 1148298 | B1 | 10/2004 |
| EP | 1621814 | | 2/2006 |
| EP | 1178748 | | 10/2006 |
| EP | 2108140 | | 6/2012 |
| FR | 2820206 | | 8/2002 |
| GB | 2211331 | | 6/1999 |
| JP | H08264469 | | 10/1996 |
| JP | 2005283039 | | 10/2005 |
| JP | 2006084322 | | 3/2006 |
| JP | 2008008548 | | 1/2008 |
| JP | 2011220560 | | 11/2011 |
| TW | 1431223 | | 3/2014 |
| WO | 9718417 | A1 | 5/1997 |
| WO | WO 2008/102263 | | 8/2008 |
| WO | WO 2009/022226 | | 2/2009 |
| WO | WO 2009/061622 | | 5/2009 |
| WO | WO 2011/104592 | | 9/2011 |

OTHER PUBLICATIONS

U.S. Appl. No. 14/225,308, filed Mar. 25, 2014.

http://www.whirlpoolwaterheaters.com/learn_more/energysmartelectricwaterheateroperation.aspx, link no longer functions, "Energy Smart Electric Water Heater Operation," 3 pages, prior to Nov. 13, 2012.

http://www.whirlpoolwaterheaters.com/learn-more/eletric-water-heaters/6th-sense%E2% . . . , "Whirlpool Energy Smart Electric Water Heater, Learn More," 3 pages, printed Jan. 15, 2015.

AO Smith, "AO Smith ICOMM Remote Monitoring System," Instruction Manual, 64 pages, Jun. 2009.

Filibeli et al., "Embedded Web Server-Based Home Appliance Networks," Journal of Network and Computer Applications, vol. 30, pp. 499-514, 2007.

"Results and Methodology of the Engineering Analysis for Residential Water Heater Efficiency Standards," 101 pages, Oct. 1998.

U.S. Appl. No. 14/689,896, filed Apr. 17, 2015.

U.S. Appl. No. 14/964,392, filed Dec. 9, 2015.

U.S. Appl. No. 15/061,520, filed Mar. 4, 2016.

U.S. Appl. No. 15/166,110, filed May 26, 2016.

Heat Transfer Products Inc., "Specification for Heat Transfer Products, Inc., Vision 3 System," 2 pages, Mar. 17, 2006.

Hiller, "Dual-Tank Water Heating System Options," ASHRAE Transactions: Symposia, pp. 1028-1037, Downloaded Nov. 16, 2012.

Honeywell International Inc., "CS8800 General Assembly, Drawing No. 50000855," 2 pages, Oct. 24, 2008.

Honeywell International Inc., "Thermopile Assembly, Drawing No. 50006821," 1 page, Jun. 18, 2010.

Honeywell International Inc., "Thermopile Element, Drawing No. 50010166," 1 page, Apr. 1, 2005.

Honeywell International Inc., "Thermopile General Assembly, Drawing No. 50006914," 1 page, Jan. 12, 2006.

Honeywell International Inc., Photograph of a CS8800 Thermocouple Assembly, 1 page, saved Oct. 9, 2014.

http://nachi.org/forum/f22/dual-water-heater-installations-36034/, "Dual Water Heater Installation," 10 pages, printed Oct. 1, 2012.

Industrial Controls, "Basics of PID Control (Proportional+Integral+Derivative)," downloaded from https://web.archive.org/web/20110206195004/http://wwww.industrialcontrolsonline.com/training/online/basics-pid-control-proportionalintegralderivative, 4 pages, Feb. 6, 2011.

InspectAPedia, "Guide to Alternative Hot Water Sources," 6 pages, printed Oct. 1, 2012.

Johnson Controls, "K Series BASO Thermocouples, Heating Line Product Guide 435.0, Thermocouples Section, Product Bulletin K Series," 8 pages, Oct. 1998.

(56) References Cited

OTHER PUBLICATIONS

Lennox, "Network Control Panel, User's Manual," 18 pages, Nov. 1999.
Moog, "M3000 Control System, RTEMP 8, Remote 8-Channel Temperature Controller with CanOpen Interface," 6 pages, Nov. 2004.
Process Technology, "Troubleshooting Electric Immersion Heaters," downloaded from http://www.processtechnology.com/troubleshootheaters.html, 3 pages, Mar. 22, 2010.
Raychem, "HWAT-ECO," Tyco Thermal Control, 4 pages, 2012.
Techno Mix, "Installation-Series and Parallel," downloaded from www.chinawinds.co.uk/diy_tips/installation_series_and_parallel.html, 5 pages, printed Oct. 1, 2012.
Triangle Tube, "Prestige Solo Condensing High Efficiency Gas Boiler," 4 pages, revised Apr. 30, 2012.
Reliance Water Heaters, "Service Handbook for Standard Residential FVIR Gas Water Heaters, Models: G/LORT, G/LORS, G/LBRT, G/LBRS/ G/LBCT, G/LBCS, G/LKRT, G/LKRS, G/LKCT, G/LART, G/LARS, G/LXRT, GLQRT—Series 200/201 and Series 202/203," 44 pages, Nov. 2009.
"Smart Device," accessed from http://encyclopedia2.thefreedictionary.com/Smart+device, 2003, 2 pp. (Applicant points out, in accordance with MPEP 609.04(a), that the year of publication, 2003, is sufficiently earlier than the effective U.S. filing date, so that the particular month of publication is not in issue.)

* cited by examiner

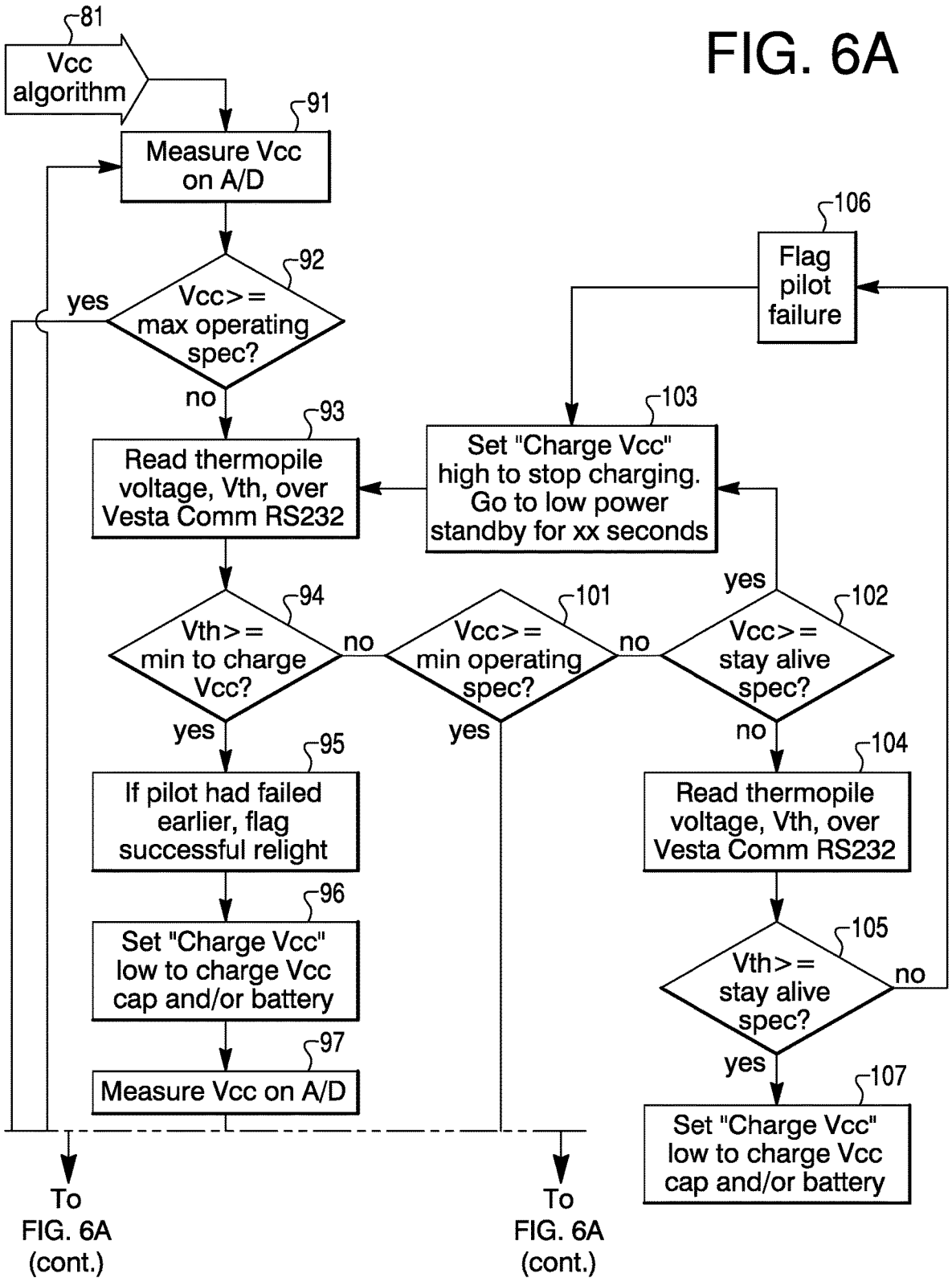
FIG. 6A
81
Vcc algorithm
91
Measure Vcc on A/D
92
Vcc>= max operating spec?
yes
no
93
Read thermopile voltage, Vth, over Vesta Comm RS232
94
Vth>= min to charge Vcc?
no
yes
95
If pilot had failed earlier, flag successful relight
96
Set "Charge Vcc" low to charge Vcc cap and/or battery
97
Measure Vcc on A/D
101
Vcc>= min operating spec?
no
yes
102
Vcc>= stay alive spec?
yes
no
103
Set "Charge Vcc" high to stop charging. Go to low power standby for xx seconds
104
Read thermopile voltage, Vth, over Vesta Comm RS232
105
Vth>= stay alive spec?
no
yes
106
Flag pilot failure
107
Set "Charge Vcc" low to charge Vcc cap and/or battery
To FIG. 6A (cont.)
To FIG. 6A (cont.)

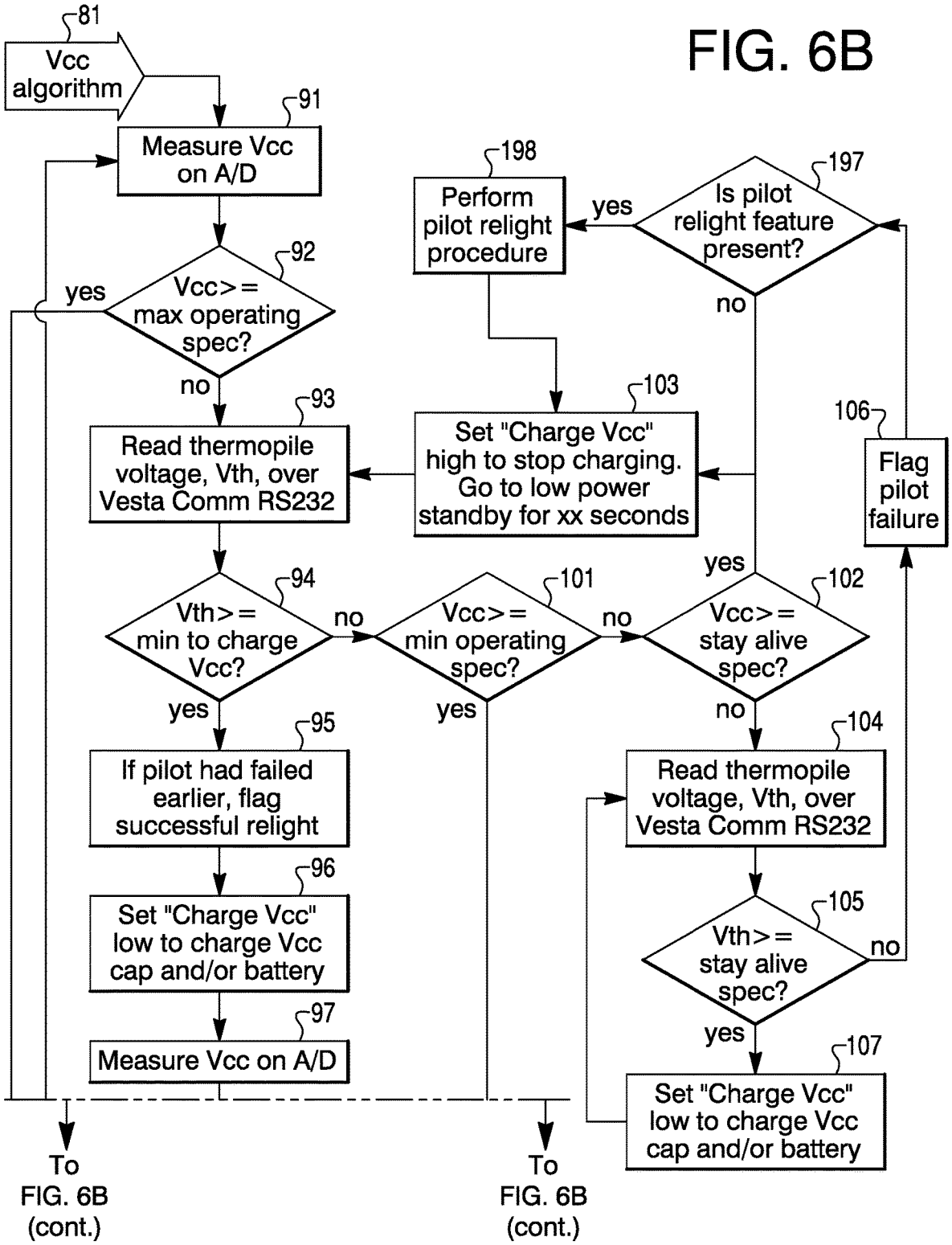
FIG. 6B
81
Vcc algorithm
91
Measure Vcc on A/D
92
Vcc>= max operating spec?
yes
no
93
Read thermopile voltage, Vth, over Vesta Comm RS232
94
Vth>= min to charge Vcc?
no
yes
95
If pilot had failed earlier, flag successful relight
96
Set "Charge Vcc" low to charge Vcc cap and/or battery
97
Measure Vcc on A/D
To FIG. 6B (cont.)
101
Vcc>= min operating spec?
no
yes
To FIG. 6B (cont.)
102
Vcc>= stay alive spec?
yes
no
103
Set "Charge Vcc" high to stop charging. Go to low power standby for xx seconds
104
Read thermopile voltage, Vth, over Vesta Comm RS232
105
Vth>= stay alive spec?
no
yes
107
Set "Charge Vcc" low to charge Vcc cap and/or battery
197
Is pilot relight feature present?
yes
no
198
Perform pilot relight procedure
106
Flag pilot failure

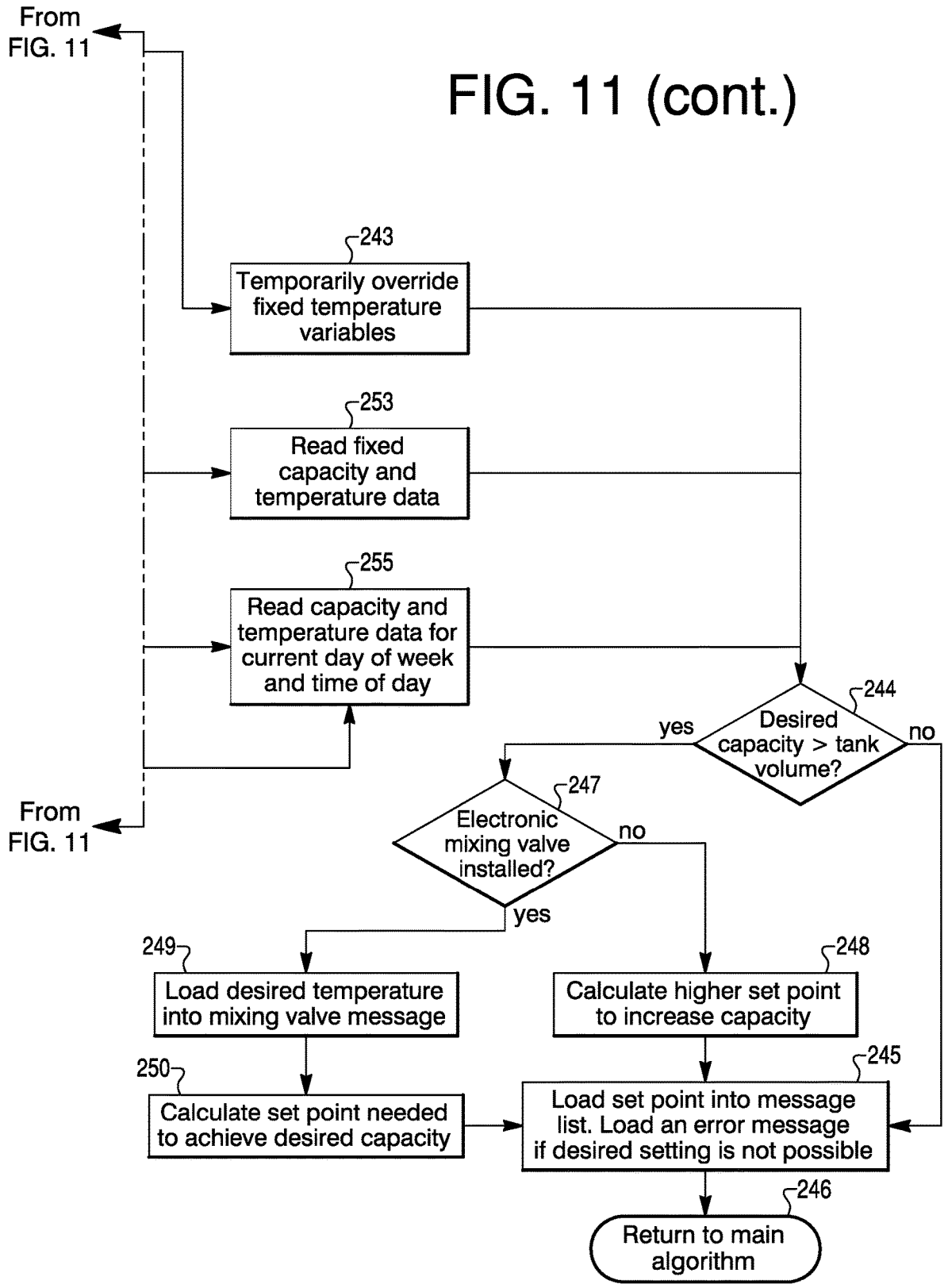
From FIG. 11
FIG. 11 (cont.)
243
Temporarily override fixed temperature variables
253
Read fixed capacity and temperature data
255
Read capacity and temperature data for current day of week and time of day
244
Desired capacity > tank volume?
yes
no
247
Electronic mixing valve installed?
no
yes
From FIG. 11
249
Load desired temperature into mixing valve message
248
Calculate higher set point to increase capacity
250
Calculate set point needed to achieve desired capacity
245
Load set point into message list. Load an error message if desired setting is not possible
246
Return to main algorithm

PILOT LIGHT CONTROL FOR AN APPLIANCE

BACKGROUND

The present disclosure pertains to pilot lighting for a heating appliance.

SUMMARY

The disclosure reveals a device for igniting a pilot light for a heating appliance or for re-igniting a pilot light that has gone out. The device may monitor a thermopile at the pilot to determine if the pilot is lit and, if not, attempt to relight it. If the device fails to relight the pilot, it may continue attempting to relight the pilot until the stored energy is nearly depleted. Before the stored energy is depleted, the device may send a message indicating a failure to relight. The last of the stored energy may be used to sound an alarm to alert a homeowner that the appliance control has shut down and the pilot could not be relit. If the amount of energy stored drops below a specified threshold and the device successfully lights the pilot, it may restore the control to normal operation, and replenish the stored energy. The device may do a standing pilot or an intermittent pilot.

DESCRIPTION

Figure 1A:
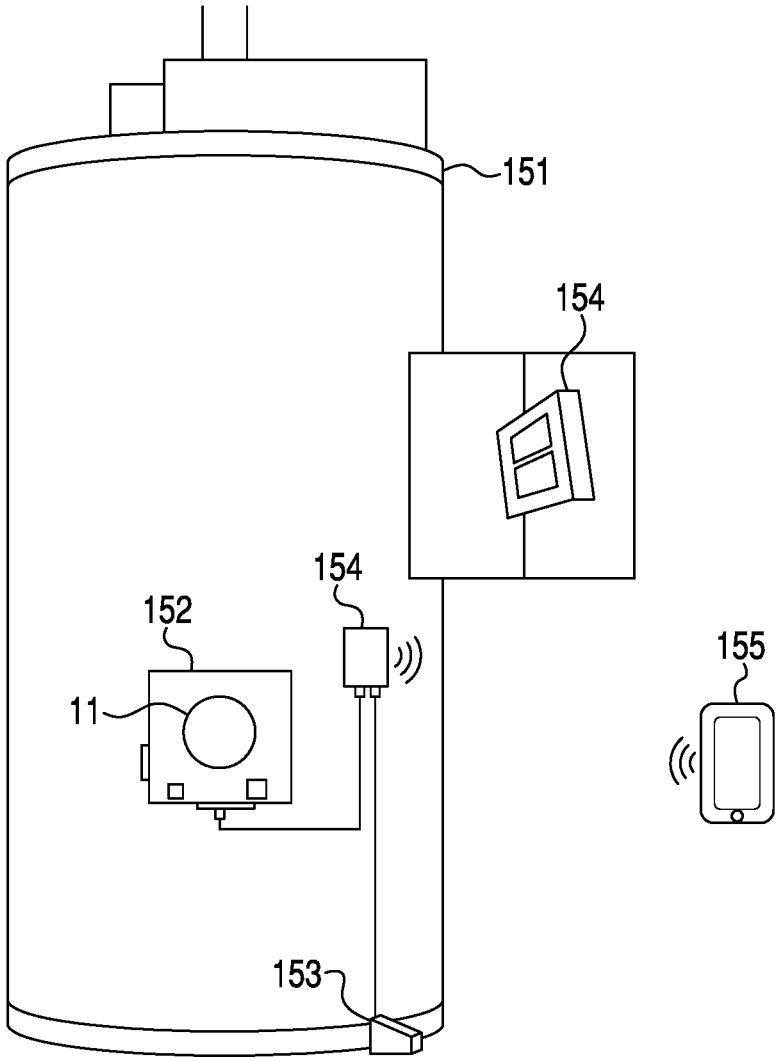
FIG. 1*a* is a diagram of a water heater having a water heater control.

The present system and approach may incorporate one or more processors, computers, controllers, user interfaces, wireless and/or wire connections, and/or the like, in an implementation described and/or shown herein.

This description may provide one or more illustrative and specific examples or ways of implementing the present system and approach. There may be numerous other examples or ways of implementing the system and approach.

Water heater regulations and customers may continuously demand higher efficiency and lower energy usage. This need may be addressed by either improving the fundamental efficiency of the water heater or by heating the water only as needed to meet the user demand. The present system may take the approach of heating the water only as needed.

There may be a water heater control with a user-demand feature. Related art water heater controls may have a control knob which primarily controls the temperature set point. The set point may set and left at a fixed level.

To control the water temperature to meet demand, similar to many home thermostats, an external device may be added to controls. The present system may provide a simplified user demand setting. It may provide less functionality than having the external device, but would cost both manufacturer and the end user less and still provide energy savings. Energy savings may be on the order of 30 percent.

Instead of having control knob settings like "Hot, A, B, C, Very Hot", the control knob may have settings like "Hot, Light Demand, Medium Demand, High Demand, Very Hot". The "Hot" and "Very Hot" settings may be unchanged from their present operation. The settings may control the set point. There may also be intermediate or additional fixed set points, but those are not necessarily shown in the Figures herein. However, the demand modes may provide hot water at the times and in the amounts that the hot water is needed. This may be accomplished in two ways. Hot water may be provided either based on 1) usage patterns, which could be simplest to set up and use, or based on 2) a preprogrammed time-temperature profile, which would require a separate user interface, and may or may not include a learning algorithm to adjust the profile for purposes such as maximizing efficiency or maximizing hot water availability. The present system may be implemented primarily through software.

Flow charts herein may illustrate a high-level process. A flow chart may show water heater control with a user demand feature.

Bi-directional communication architecture and optimizing software for gas and electric water heaters may be noted. The energy storage aspect of a tank water heater may significantly change the algorithm requirements to achieve the time-temperature profile that users are familiar with through their home thermostats. A manufacturer may currently have a 60+ percent share of the gas water heater segment. Beyond the initial sale of the gas water heater valve, the manufacturer does not necessarily have the capability to generate additional revenues from the installed base of water heaters using its controls. While the manufacturer's control may have a communicating feature, there appears no easy way for a homeowner to communicate with a water heater valve or control. With an ability to communicate with a water heater, multiple offerings/features may be developed that can generate revenue for the manufacturer.

The present system may allow communication between a smart device and the water heater. The system may also include water heater optimization software that can reduce the cost to operate a water heater, provide for usage pattern based optimization, prognostics for sediment build up and alarming, annual maintenance alarms, performance optimization alerts, and demand response management for utility load shedding.

The present system may also be used to control multiple water heaters together, although system would not necessarily have to be used for this function. For multiple water heaters, the controls may be connected either wirelessly or with a cable.

The present system may consist of a battery powered (or other energy storage approach such as capacitor), flame powered, or plug-in powered wireless communication. The wireless communication module may be a box that provides communication with a manufacturer's VestaCOM™ and ECOM™ to communicate with the valve. The wireless communication (e.g., WiCOM) may communicate wirelessly with a smart device such as a Kindle™, iPad™, PC/laptop, or Wi-Fi™ (WiFi™) router. The WiCOM may also include water heater optimization software. Wireless communication may be a feature of the add-on control module. Wireless communication may be a function that is separate from optimization software.

The WiCOM device may be a slave device to the water heater control valve. The WiCOM device may be embedded in the water heater control itself.

The controller/communications device may be sold directly at many retail stores. Consumers may purchase the device to link the water heater control with their smart device. Consumers may then download the latest version of the water heater optimization software from a website of the manufacturer. The software may provide for an interactive screen where consumers answer key questions about their hot water usage. This approach may allow the device to change water heater set points and optimize operation of the water heater.

A communication module may also permit an interface with the manufacturer's thermostats either as a way to control water heater settings or as a way to read the home heating/cooling schedule on another smart device and apply that schedule to the water heater usage profile.

A standing pilot automatic relight or conversion to intermittent pilot for a standing pilot water heater may be noted. Standing pilot appliances may have some issues. First, the pilot may continuously consume energy/gas that is mostly wasted. Second, the pilot may go out and the appliance will then no longer function until someone manually relights the pilot.

The appliances to which the pilot applies may include water heaters, furnaces, stoves/ovens, and so forth, but can focus on the Vesta™ water heater control hereafter because that control has the specific circuit and hardware necessary for the present system to work. However, the pilot may also apply to any appliance control that has similar hardware.

The present system may be a device that can relight the pilot automatically on a Vesta water heater valve, but does not necessarily require an external power source such as a wall outlet. Because the device may do this, it may also convert a standing pilot Vesta water heater valve into an intermittent pilot, saving 500-700 BTU/hr. of gas consumption. If this functionality were included in a device that included communication to a Wi-Fi network and/or the internet, then it could also send messages to the homeowner (such as attempting to relight if pilot is intended to be left on as a standing pilot, success or failure to relight, the amount of hot water available and its temperature).

A device may have energy storage that could be charged through an RS232 VestaCom port on a Vesta water heater controller or another connection location that could be added to the controller that is connected to the internal voltage source. As mentioned in herein, the relighting feature may be included in that device. However, it may also be possible to create a simpler device that has the same energy storage and relighting feature, but would not have the other features such as communication, support for a leak detector and water shutoff valve, and so on. Such a device may be solely for the purpose of relighting the pilot and/or converting a standing pilot Vesta to an intermittent pilot.

Figure 13:
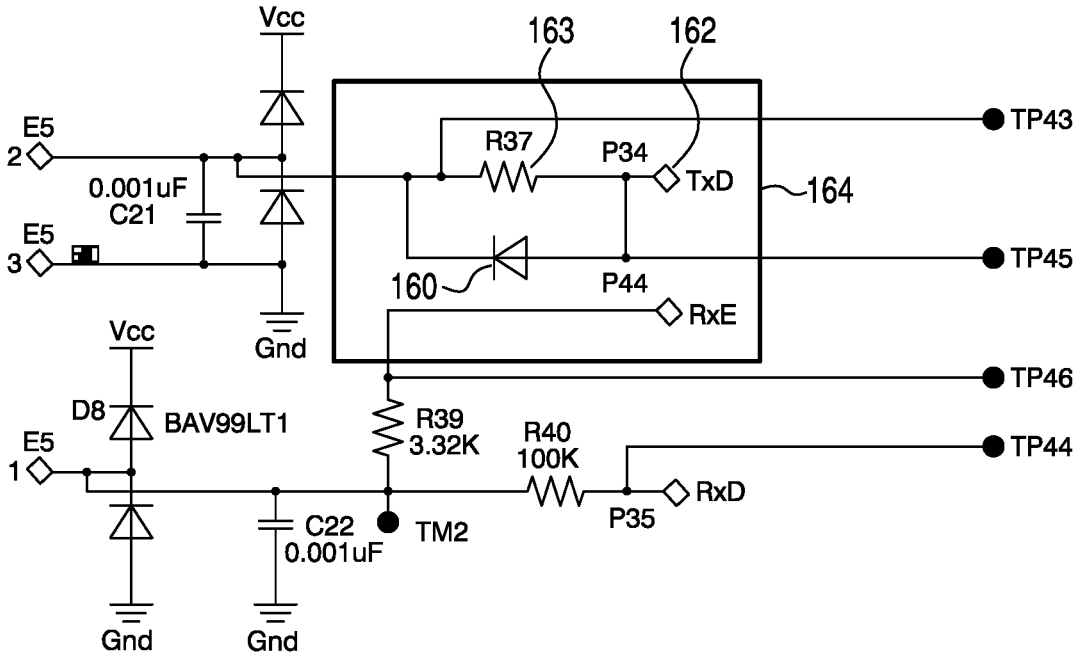
FIG. 13 is a circuit diagram having a diode added in parallel to a resistor in a transmitting line for a control circuit.
Figure 14A:
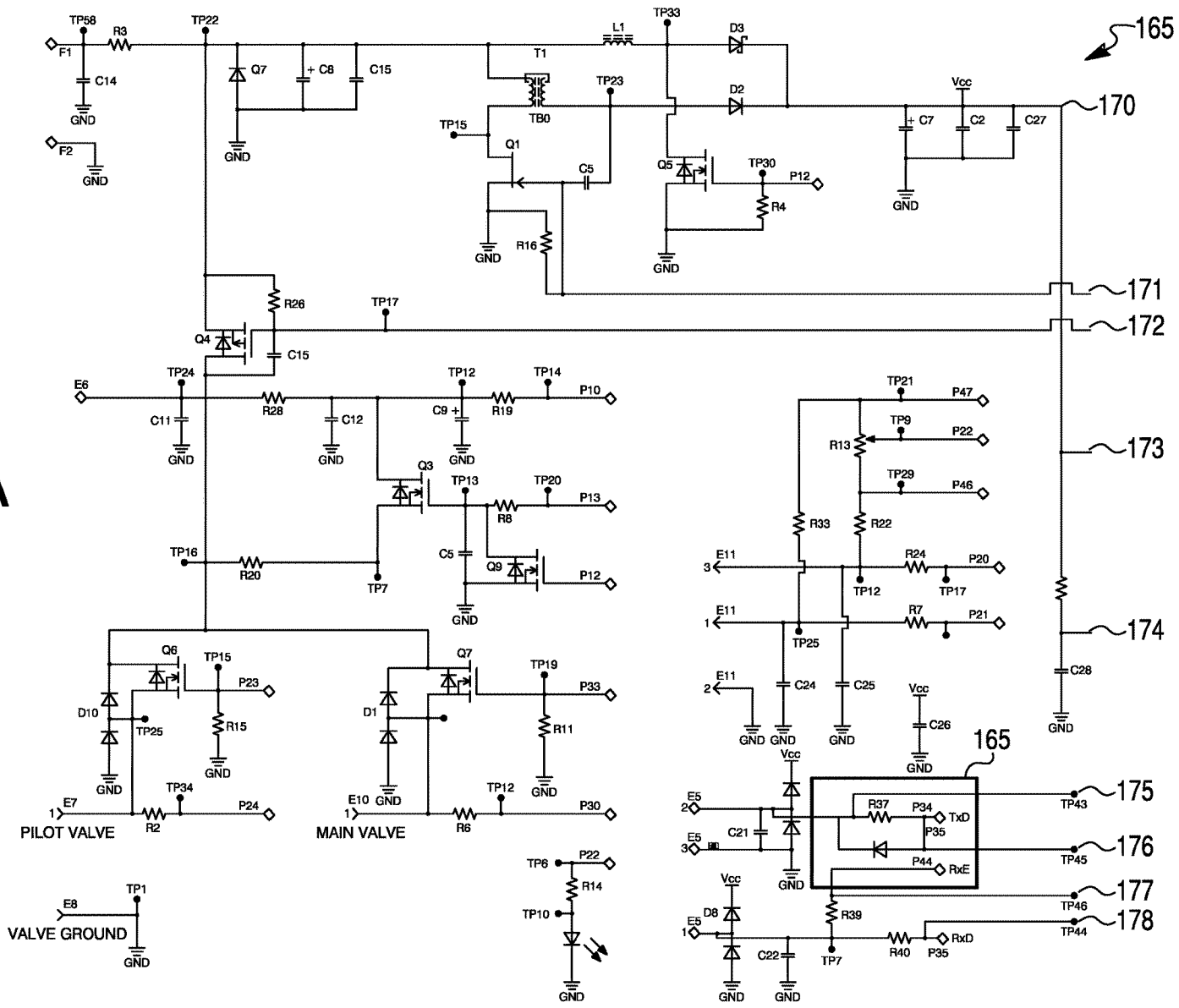
FIGS. 14*a* and 14*b* constitute a schematic showing a context of the diode in the diagram of FIG. 13.
Figure 14B:
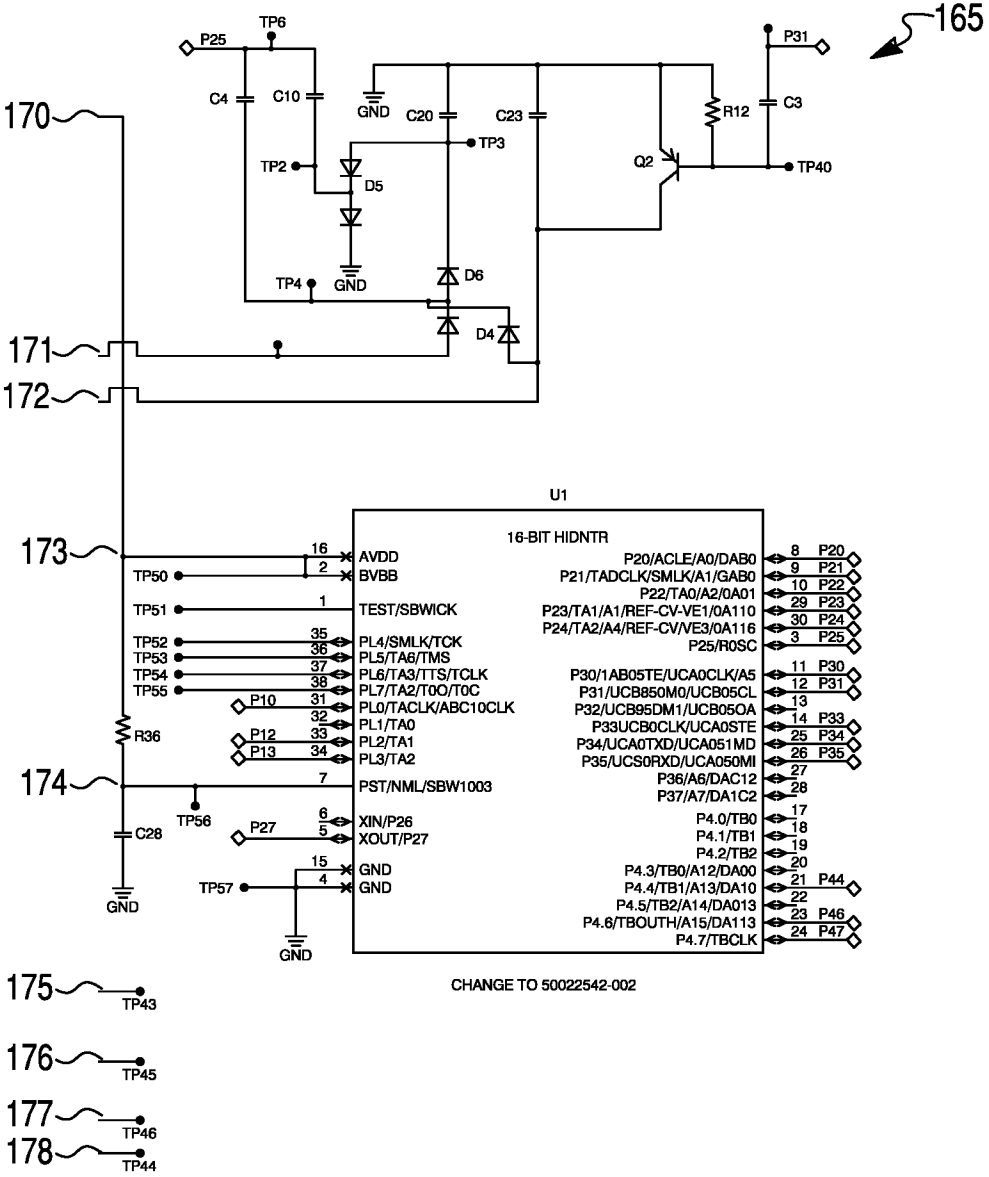

The device's key functional blocks may include: 1) circuitry necessary to store energy; 2) a circuit to ignite the pilot similar or identical to the standard circuit in power vent water heater controls; 3) a microprocessor; and 4) an RS232 communication circuit modified to allow current to flow from the Vesta's RS232 Tx line to charge/power the device. The present system may have a circuit area 164 of FIG. 13 with a diode 160 added in parallel to a resistor 163 in the Tx line 162, but it is not necessarily needed. Circuit area 164 is shown in a context of a circuit 165 of FIG. 14*a* and FIG. 14*b*. Common wires and connections of circuit 165 may be indicated by numerals 170, 171, 172, 173, 174, 175, 176, 177 and 178.

Alternately, another connection location may be added to the Vesta controller that is connected to the internal voltage source.

In the case of a device intended to relight the pilot if it goes out, the device may monitor the thermopile voltage or other detection or source through the RS232 to determine if the pilot is lit. The monitoring could be periodic, maybe once, for example, every 5 minutes, to conserve power. If the thermopile voltage dropped below a minimum threshold or if communication were lost, then the device may recognize that the pilot has gone out and that the Vesta controller has stopped functioning. Using the energy stored in the device, power may be applied through the Vesta's RS232 Tx line to bring the Vesta controller's Vcc back up and operate the control. The device may then send a message to the Vesta control's Rx line to open the pilot valve. Once the pilot is open, the device may activate its spark ignition circuit to ignite the pilot. It may continue to do this every few seconds for some short period of time, possibly 30 seconds, and then remove power from the Tx line, check for communications with the Vesta control and check the thermopile voltage. If communications fail, the system may continue to attempt to relight the pilot until the stored energy is nearly depleted. If the device is equipped with Wi-Fi, before the stored energy is depleted, it may send a message indicating a failure to relight and the amount of hot water available. Whether or not the device is equipped with WiFi, it may be possible to use the last of the stored energy to sound an audio alarm to alert the homeowner that the water heater control has shut down.

The case of a device intended to convert the standing pilot to intermittent pilot may be noted. The device may operate in a similar manner as noted herein, but when a main burn cycle is completed, the device may then instruct the Vesta controller to shut down the pilot valve. While the pilot is shut down, the controller may periodically, possibly, for example, every 10 minutes, apply power to the Vesta controller to wake it up and read the water temperature. If the water temperature has dropped to a level requiring a burn cycle, then the device may light the pilot, restore the Vesta control to normal operation, and recharge the stored energy as much as possible during the burn cycle. If the amount of energy stored has dropped below a specified threshold, the device may light the pilot, restore the Vesta control to normal operation, and activate a function to recharge the stored energy, although a main burn cycle may not be needed during this time.

It may be possible to have the device do either a simple relight function or convert to a standing pilot by putting a selector switch on the device to change between these two modes. In the case of a device with Wi-Fi communication capability, these modes may be selected through a smart phone or device.

FIG. 1*a* is a diagram of a water heater 151 having a water heater control 152 and a leak sensor 153. Water heater control 152 may have a control knob 11. A wireless control 154 may be attached to water heater 151. Wireless control 154 may be connected to leak sensor 153 and water heater control 152. A designated website may be visited with a smart device 155 where an applicable app may be downloaded and device 155 in turn may connect to the wireless control 154. FIGS. 1*c*-1*i* are diagrams showing various views of an example smart device 155. For examples, one view reveals a temperature adjustment for water heater 151 and another view reveals alarms and alerts such as a low water heater capacity warning. Device 155 may instead be wired to control 154. Additional accessories besides the leak detector may be attached to the device.

Figure 1B:
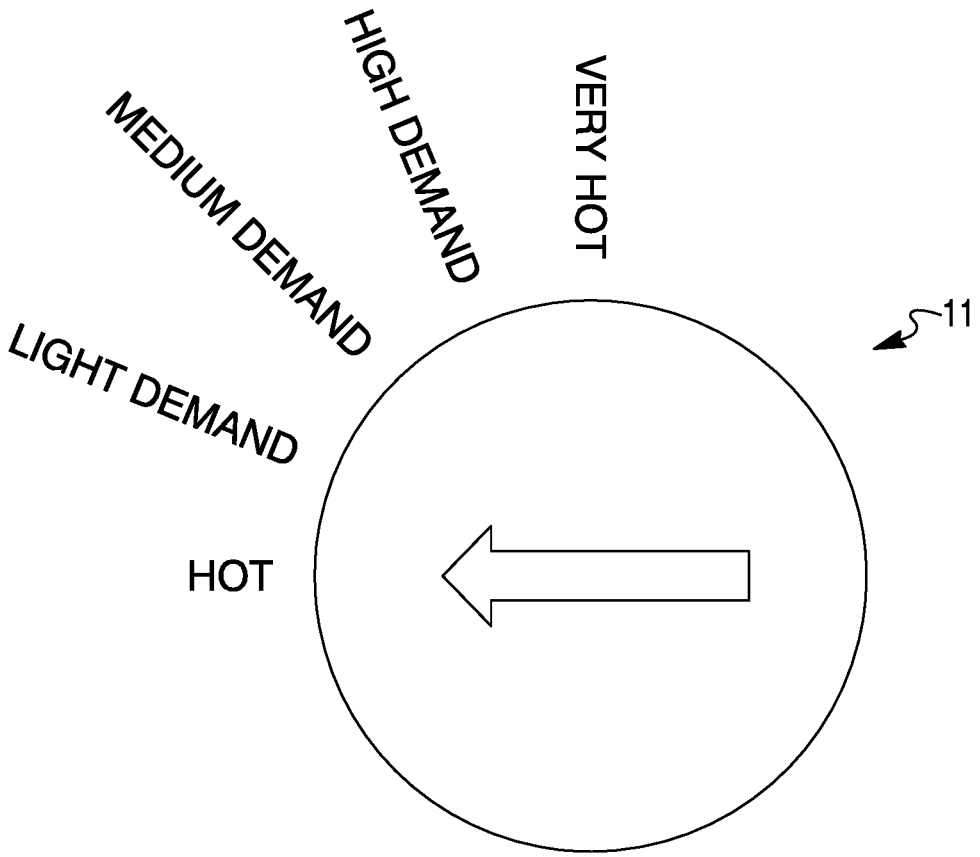
FIG. 1*b* is a diagram of control knob that may be used with a control for a water heater.
Figure 1C:
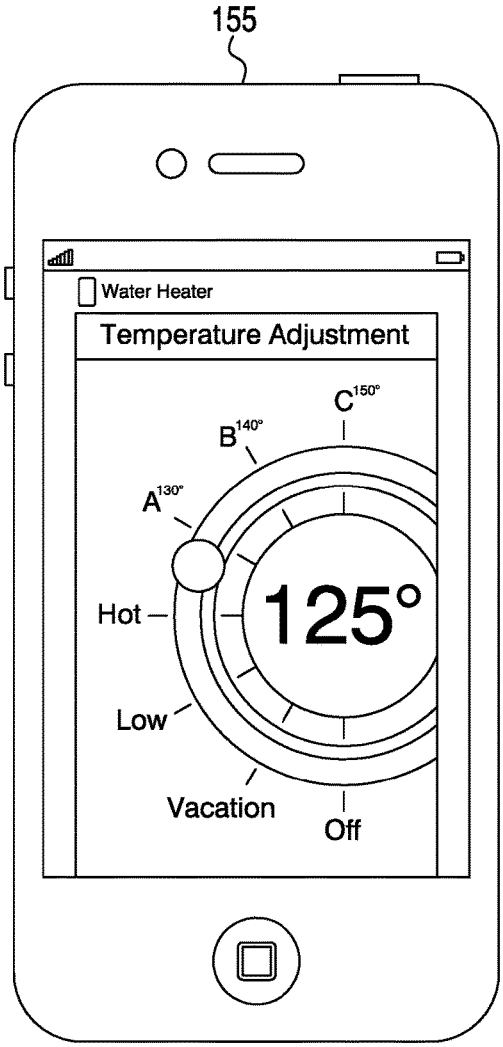
FIGS. 1*c*-1*i* are diagrams showing various views of an example smart device.
Figure 1D:
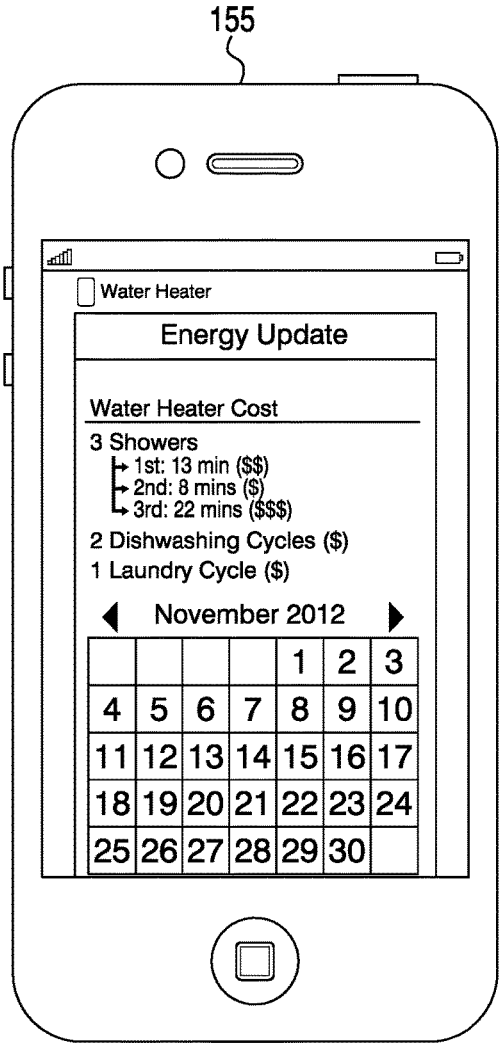
Figure 1E:
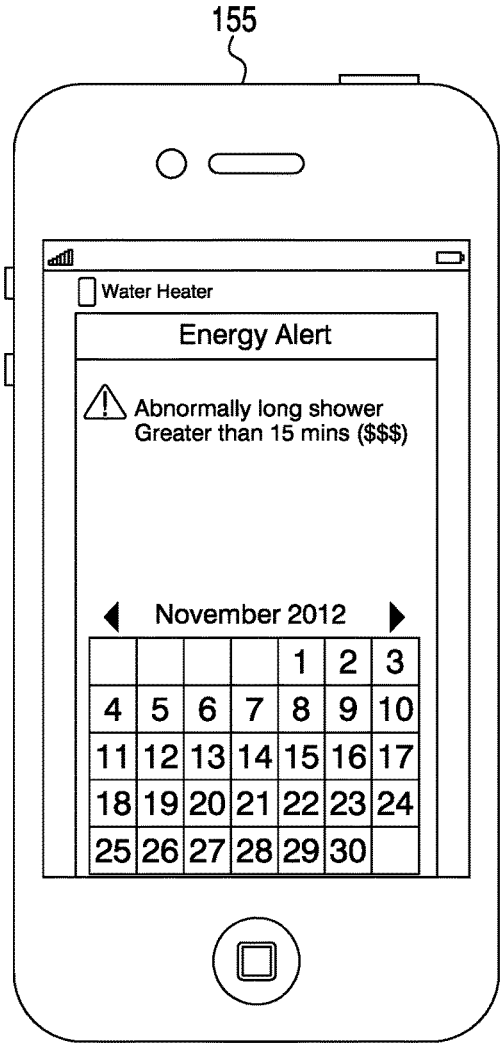
Figure 1F:
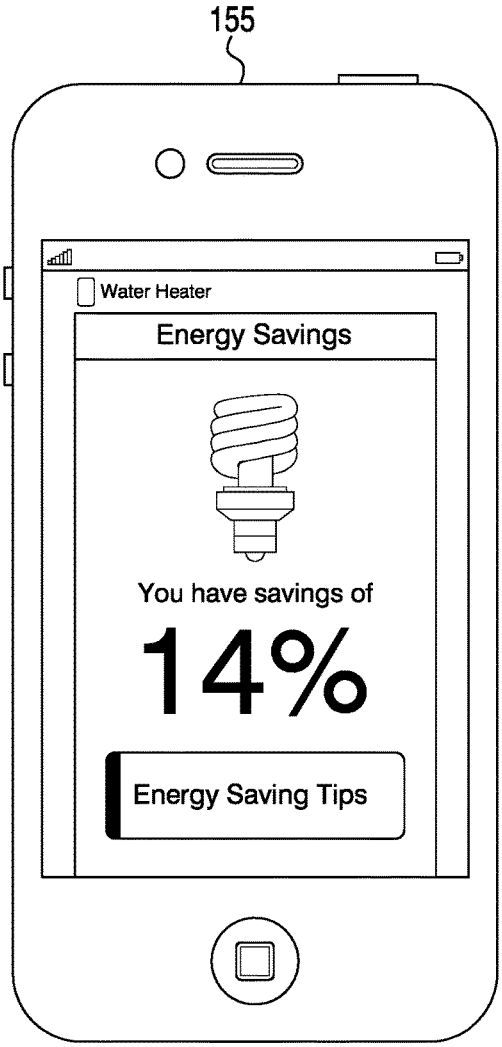
Figure 1G:
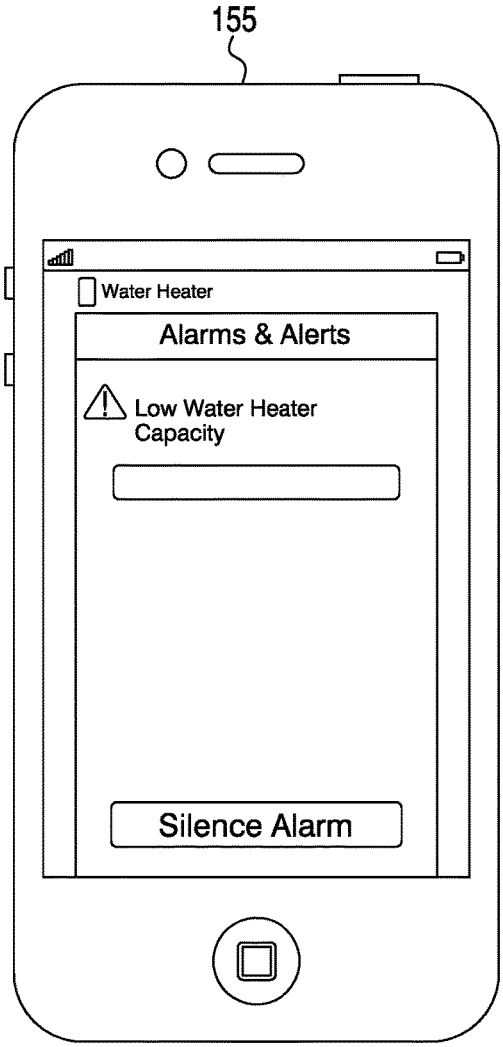
Figure 1H:
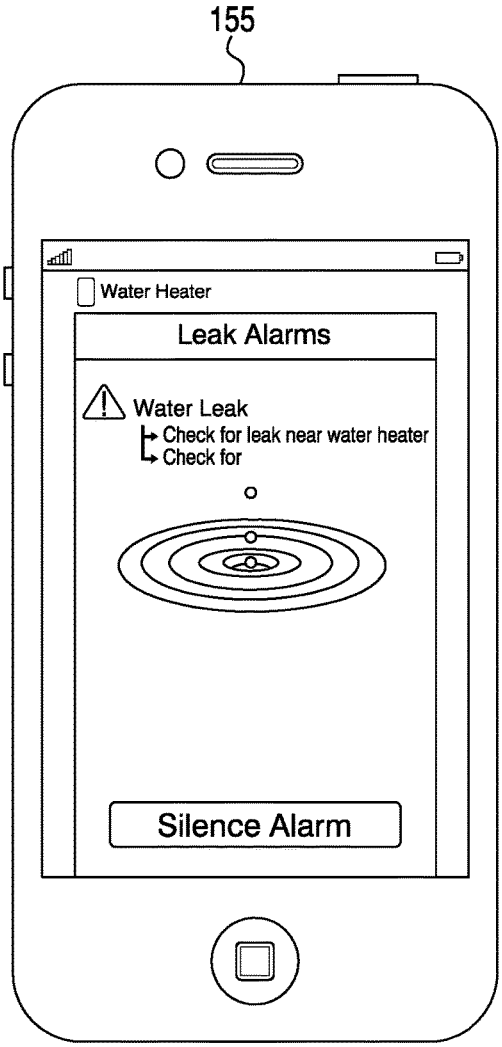
Figure 1I:
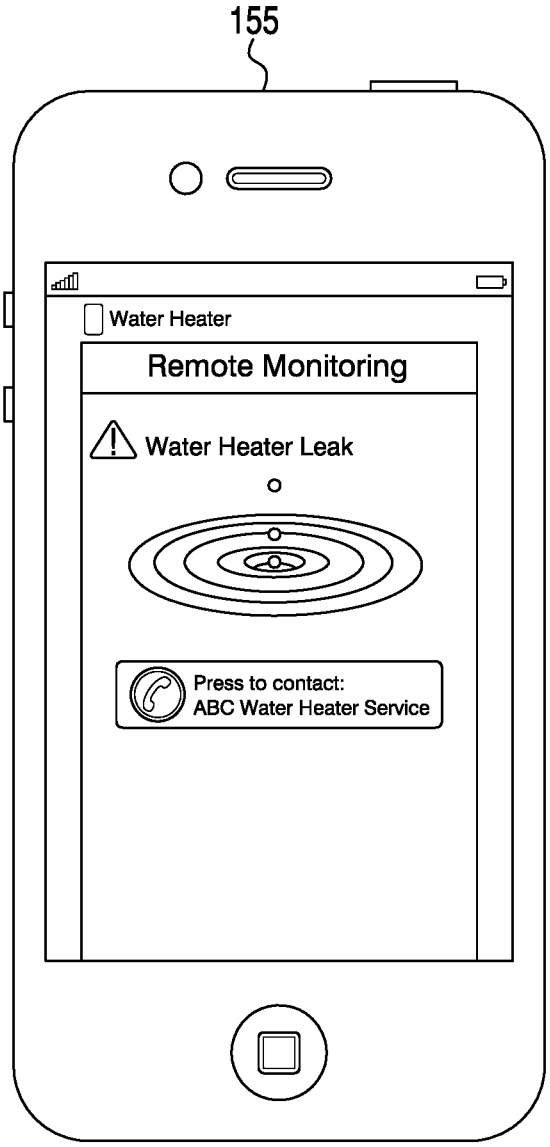

FIG. 1*b* is a diagram of control knob 11 that may be used with a control for a water heater or other like appliance. Control knob 11 may have a setting upon which a selection can be made. The selections may incorporate "Hot", "Light Demand", "Medium Demand", "High Demand", and "Very Hot".

Figure 3:
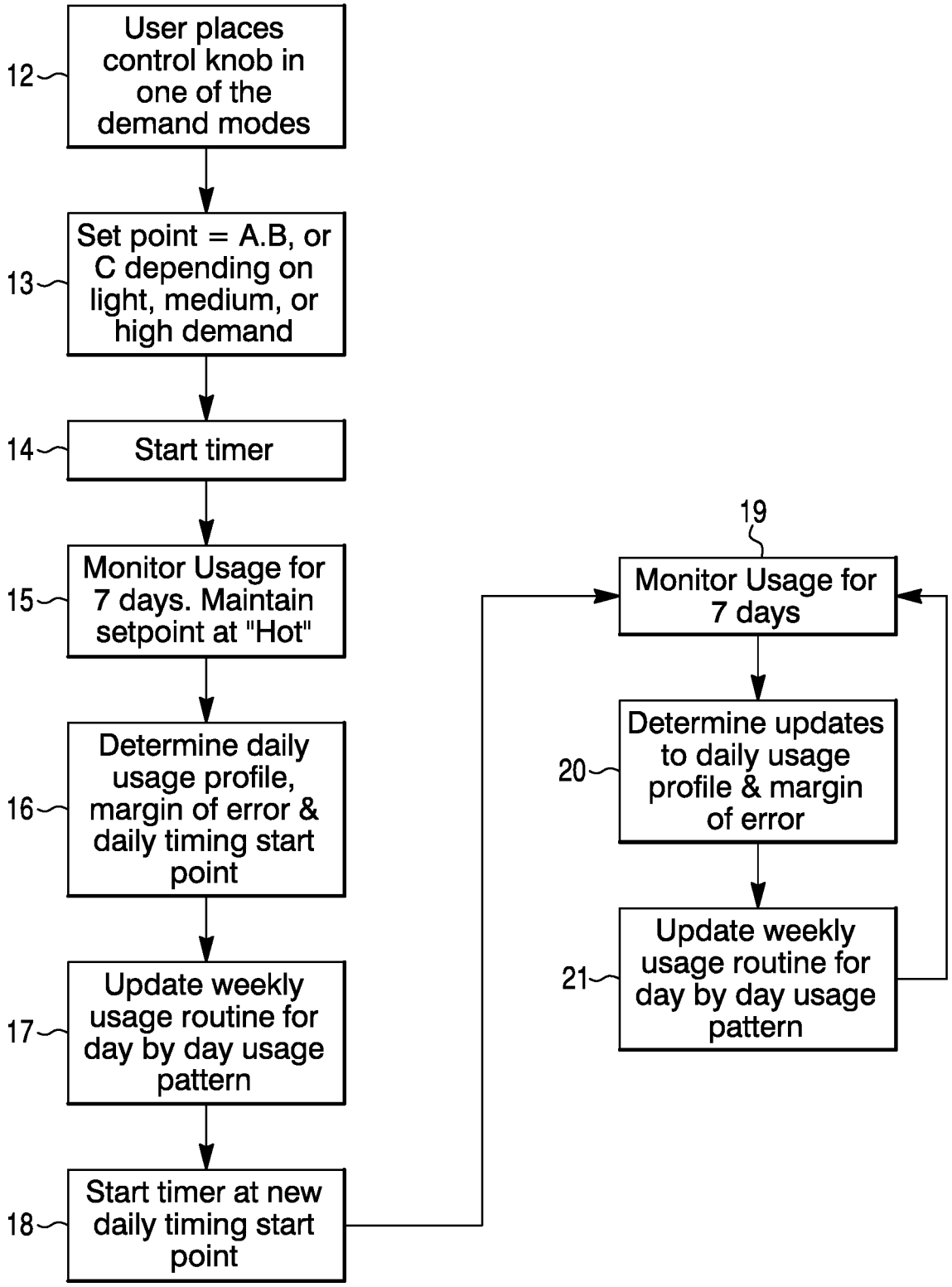
FIG. 3 is a diagram of activity relative to demand based on user programmed patterns.

FIG. 3 is a diagram of activity relative to a demand that may be based on usage patterns. The various items of activity may be indicated as steps, blocks, symbols or the like. Symbol 12 may indicate a user that places the control knob in one of the demand nodes. A set point may equal A, B or C, depending on light, medium or high demand, as indicated in symbol 13. The level of demand may also indicate a statistical confidence level used in determining the confidence that a user will have hot water at any desired time based on usage history. A timer may be started at symbol 14. At symbol 15, hot water usage may be monitored for seven days while the set point is maintained at "Hot". A daily usage profile, margin of error and daily timing start point may be determined at symbol 16. A weekly usage routine or day by day usage pattern may be maintained, as indicated in symbol 17. Symbol 18 indicates that the timer may be started at a new daily timing start point. According to symbol 19, usage of hot water may be monitored for seven days. Updates to a daily usage profile and margin of error may be determined at symbol 20. A weekly usage routine for a day by day usage pattern may be updated according to symbol 21. The updated weekly usage routine may be provided from symbol 21 to symbol 19 where hot water usage is monitored for seven days.

Figure 2:
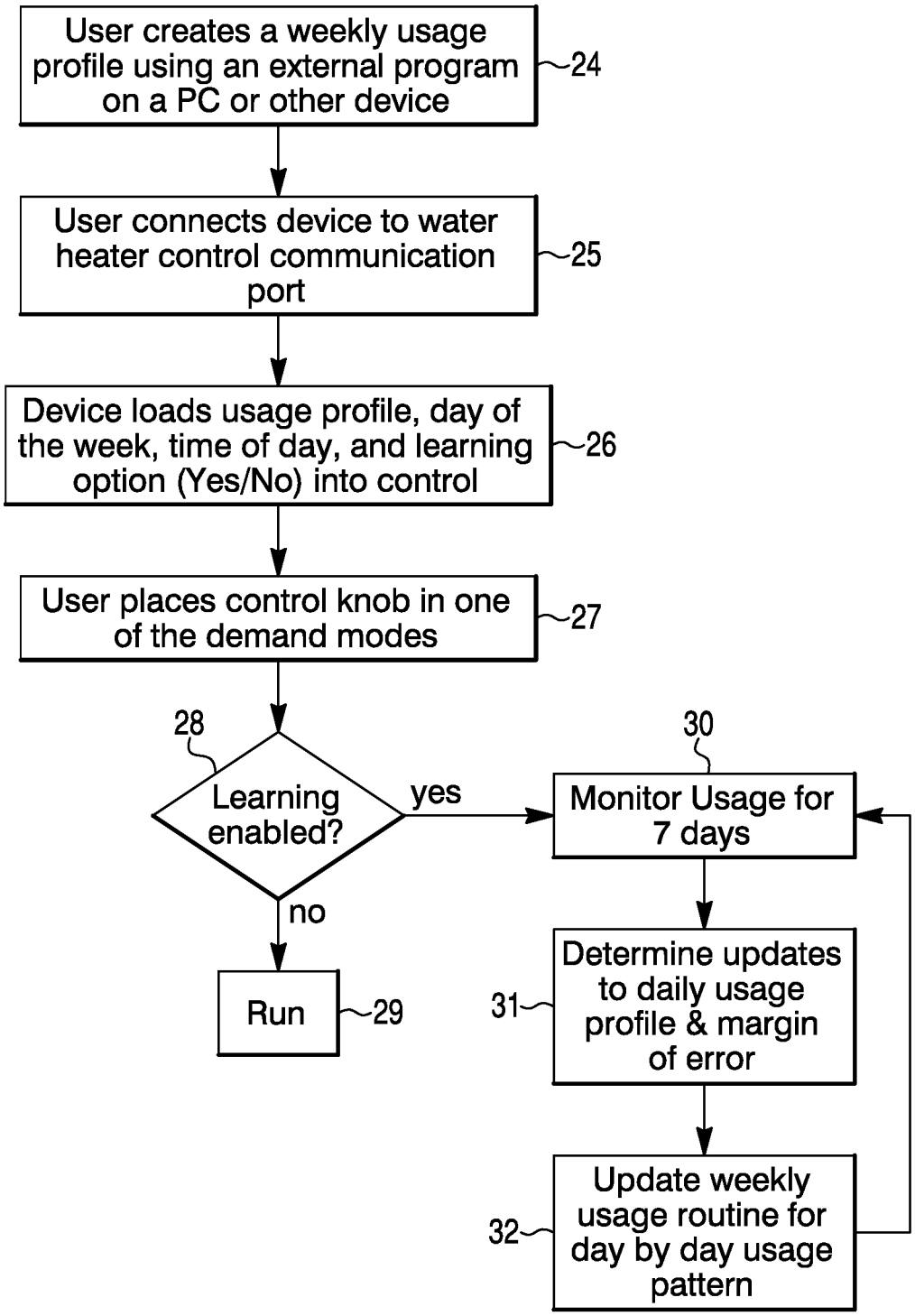
FIG. 2 is a diagram of activity relative to a demand that may be based on usage patterns.

FIG. 2 is a diagram of activity relative to a demand based on user programmed patterns. At symbol 24, a user may create a weekly usage profile using an external program on a computer or other device. The user may connect a device to a water heater control communication port at symbol 25 or connects communications wirelessly or by wire. The device may load a usage profile, day of the week, time of the day and enable or disable a learning option into the control at symbol 26. A question indicated at symbol 28 may be whether learning is enabled. If not, then a run may occur at symbol 29. If yes, then usage may be monitored for seven days at symbol 30. Symbol 30 may also indicate to enter run mode. Updates to a daily usage profile and margin of error may be determined at symbol 31. At symbol 32, a weekly usage routine for a day by day usage pattern may be updated. After symbol 32, the user may return to symbol 30, and proceed through the activity indicated in noted symbols 30-32.

Figure 4A:
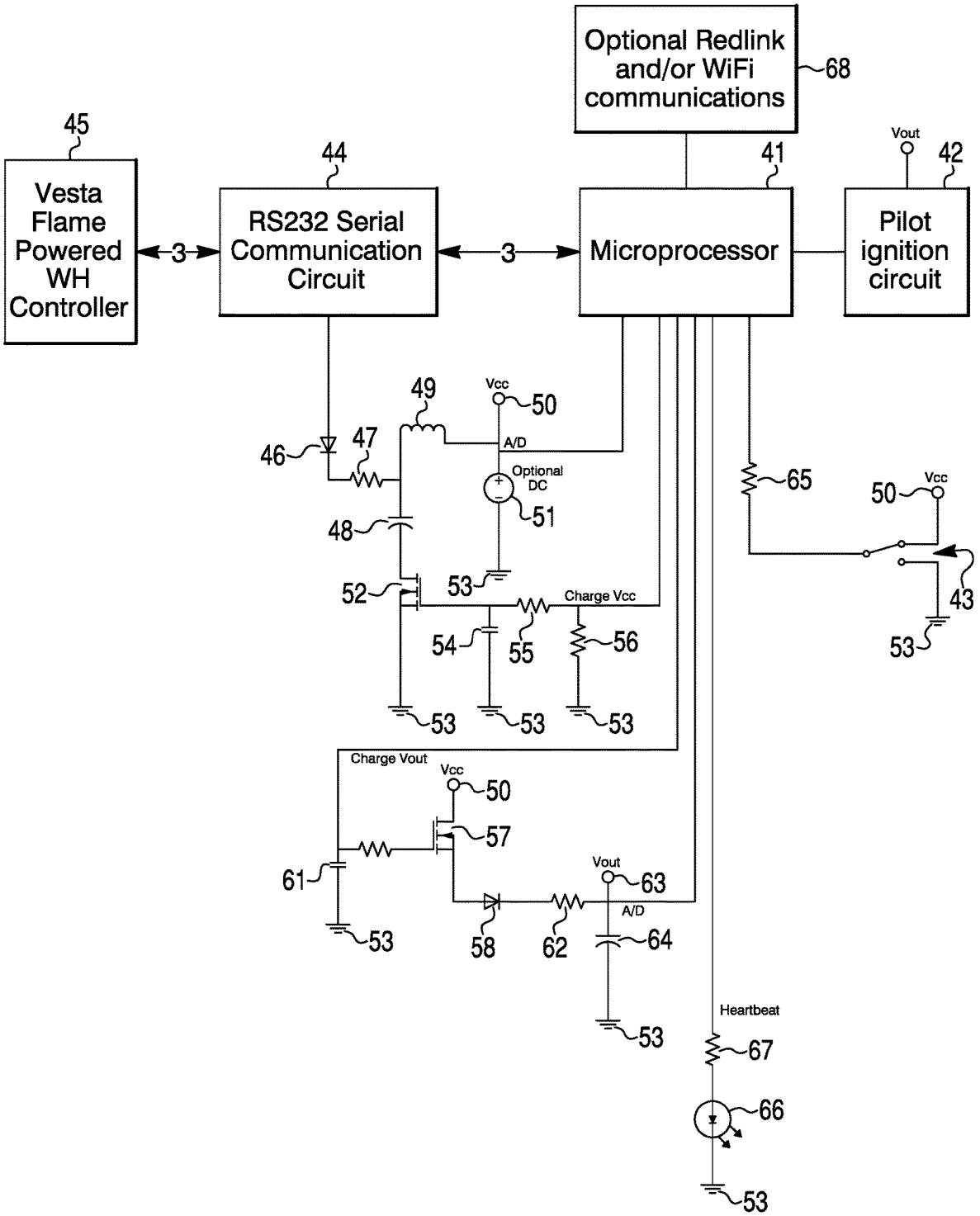
FIG. 4*a* is a diagram of a circuit relating to pilot lighting components.

FIG. 4*a* is a diagram of a circuit relating to pilot lighting components. A microprocessor 41 may connected to a pilot ignition circuit 42 having a Vout terminal 63 that may be connected to an igniter or sparker for lighting the pilot. A mode switch 43 may be connected to processor 41 via a resistor 65. Mode switch 43 may be used to select an automatic pilot relight or an intermittent pilot. Processor 41 may be connected to an RS232 serial communication circuit 44. Communication circuit 44 may be connected to a (Vesta) flame powered water heater controller 45. An output from circuit 44 may go through a diode 46 and resistor 47 to one end of a capacitor 48 and one end of an inductor 49. The other end of inductor 49 may be connected to a positive terminal of an optional DC source 51 and to microprocessor 41, and to a terminal 50 for Vcc. The other end of capacitor 48 may be connected to a drain of an N-channel FET 52. A source of FET 52 may be connected to a ground 53. A gate of FET 52 may be connected to one end of a capacitor 54 and a resistor 55. The other end of capacitor 54 may be connected to ground 53. The other end of resistor 55 may be connected to one end of a resistor 56 and to processor 41 via a line labeled charge Vcc. The other end of resistor 56 may be connected to ground 53.

The components shown and mentioned may be substituted with other components. For example a P channel FET may also work with the appropriate modifications. The approach may incorporate an ability to store energy coming from the thermopile or another energy source, by whatever means.

An N-channel FET 50 may have a drain connected to terminal 50 and a source connected to an anode of a diode 58. A gate of FET 57 may be connected to one end of a resistor 59. The other end of resistor 59 may be connected to processor 41 via a line labeled "Charge Vout" and to one end of a capacitor 61. The other end of capacitor 61 may be connected to ground 53. The cathode of diode 58 may be connected to one end of a resistor 62. The other end of resistor 62 may be connected to processor 41, a terminal 63 for Vout, and one end of a capacitor 64. The other end of capacitor 64 may be connected to ground 53.

A LED 66 may have one terminal connected to ground 53 and another terminal connected via a resistor 67 and a line labeled heartbeat to processor 41. This may be for the purpose of providing a periodic flash of light to show the user that the system is functioning Processor 41 may be connected to an optional wireless communication system 68, such as WiFi or other like system. System 68 may be a plug-in module.

For twinning applications, having two or more water heaters proximate to each other, there may be two or more sets of circuits for RS232 and a pilot ignition versus requiring one control module on each water heater. An extra pilot ignition may be a plug-in module. The two sets or more of circuits may be incorporated in very different operating systems. Other accessories may plug in to a circuit.

Figure 4B:
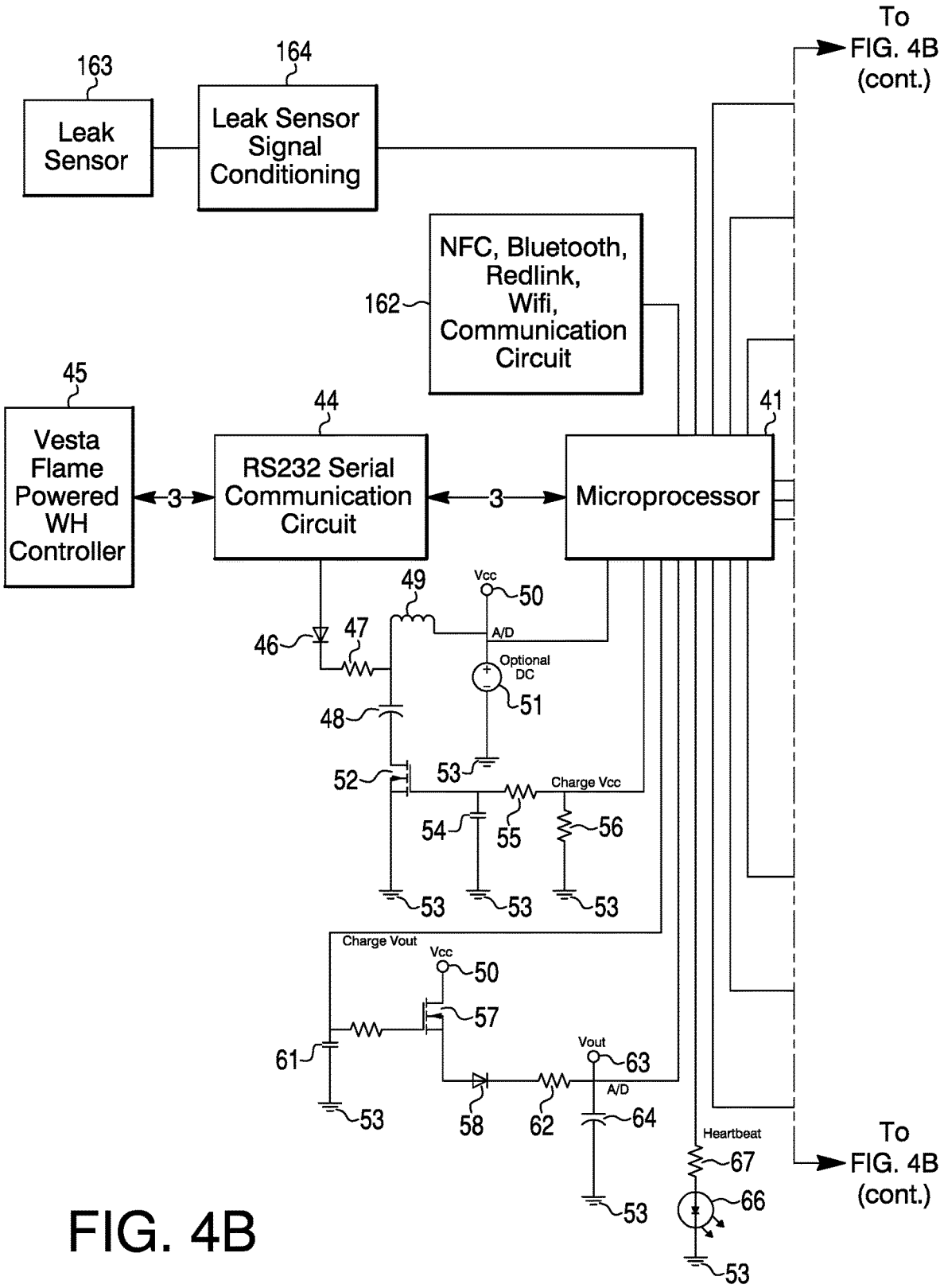
FIG. 4*b* is a diagram having some circuitry similar to that of FIG. 4*a* but relating to water heater operation.
Figure 4B:
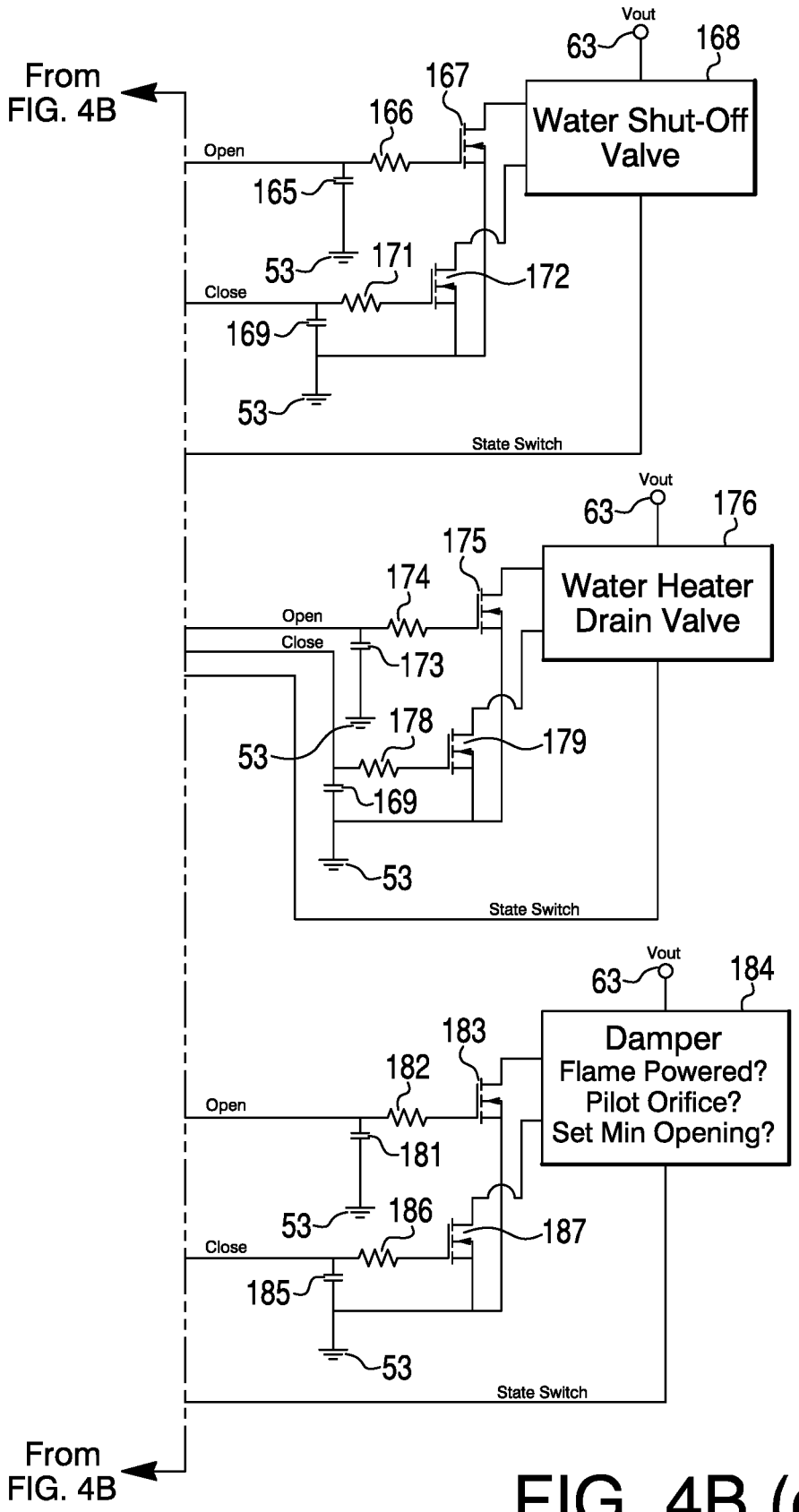

A smart device or computer wired interface may only be needed if WiFi or other wireless communications are incorporated. A software application may be needed in either case FIG. 4*b* is a diagram having some circuitry similar to that of FIG. 4*a* but relating to water heater operation. An NFC (near field communication), Bluetooth™, RedLink™, and/or WiFi™ communication circuit 162 may be connected to microprocessor 41. A leak sensor 163 may be connected to a leak sensor signal conditioning circuit 164. Conditioning circuit may be connected to microprocessor 41.

An open line from processor 41 may be connected to a capacitor 165 and resistor 166. The other end of capacitor 165 may be connected to ground 53 and the other end of resistor 166 may be connected to a gate of an N channel FET 167. FET 167 may have a drain connected to a water shut-off valve 168. Valve 168 may be connected to Vout 63. A source of FET 167 may be connected to ground 53. A close line from processor 41 may be connected to a capacitor 169 and a resistor 171. The other end of capacitor 169 may be connected to ground 53 and the other end of resistor 171 may connected to a gate of an N channel FET 172. FET 172 may have a drain connected to water shut-off valve 168. A source of FET 172 may be connected to ground 53. A state switch line from processor 41 may be connected to valve 63.

An open line from processor 41 may be connected to a capacitor 173 and resistor 174. The other end of capacitor 173 may be connected to ground 53 and the other end of resistor 174 may be connected to a gate of an N channel FET 175. FET 175 may have a drain connected to a water heater drain valve 173. Valve 173 may be connected to Vout 63. A source of FET 175 may be connected to ground 53. A close line from processor 41 may be connected to a capacitor 177 and a resistor 178. The other end of capacitor 177 may be connected to ground 53 and the other end of resistor 178 may be connected to a gate of an N channel FET 179. FET 179 may have a drain connected to drain valve 176. A source of FET 179 may be connected to ground 53. A state switch line from processor 41 may be connected to valve 176.

An open line from processor 41 may be connected to a capacitor 181 and resistor 182. The other end of capacitor 181 may be connected to ground 53 and the other end of resistor 182 may be connected to a gate of an N channel FET 183. FET 183 may have a drain connected to a damper 184 that possibly is flame power, at a pilot orifice and/or having a set minimum opening. Damper 184 may be connected to a Vout 63. A close line from processor 41 may be connected to a capacitor 185 and a resistor 186. The other end of capacitor 185 may be connected to ground 53 and the other end of resistor 186 may be connected to a gate of an N channel FET 187. FET 187 may have a drain connected to damper 184. A source of FET 187 may be connected to ground 53. A state switch line may be connected to damper 184.

Figure 5A:
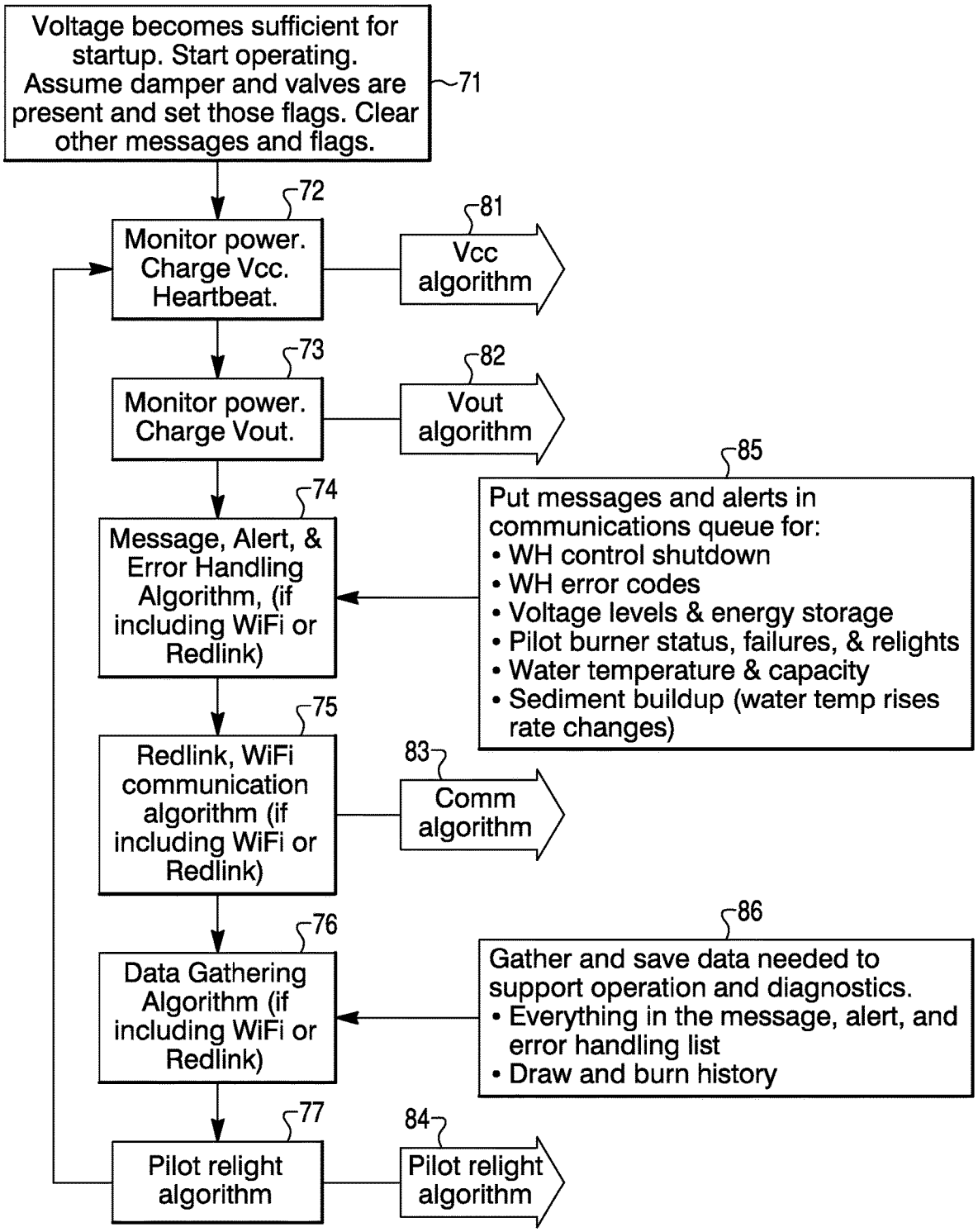
FIG. 5*a* is a diagram of a flow of activity related to a water heater system.

FIG. 5*a* is a diagram of a flow of activity related to a water heater system. Symbol 71 indicates that a voltage supply may become sufficient for startup. The system may start operating. A damper and valves may be assumed to be present and their flags may be set. Other messages and flags may be cleared. Power, charge, Vcc and heartbeat may be monitored at symbol 72. These items may be effected with a Vcc algorithm 81. Power and charge Vout may be monitored at symbol 73. The items may be effected with a Vout algorithm 82. At symbol 74, message, alert and error handling may utilize an algorithm if including WiFi or to other wireless mechanism. Messages and alerts may be put in a communications queue for water heater control shutdown, water heater error codes, voltage levels and energy storage, pilot burner status, failures and relights, water temperature and capacity, and sediment buildup (water temperature rise rate changes) as indicated in symbol 85.

WiFi or other wireless mechanism may utilize a communication algorithm 83 if WiFi or other such mechanism is incorporated as indicated in symbol 75. If incorporating WiFi or other wireless mechanism, a data gathering algorithm may be used. At symbol 86, data as needed may be gathered and saved to support an operation and diagnostics, such as everything in a message alert and error handling list. Water draw and gas burn history may be gathered and saved. At symbol 77, the pilot may be relit according to an algorithm 84. After symbol 77, the flow of activity may be repeated from symbols 72 through 77.

Figure 5B:
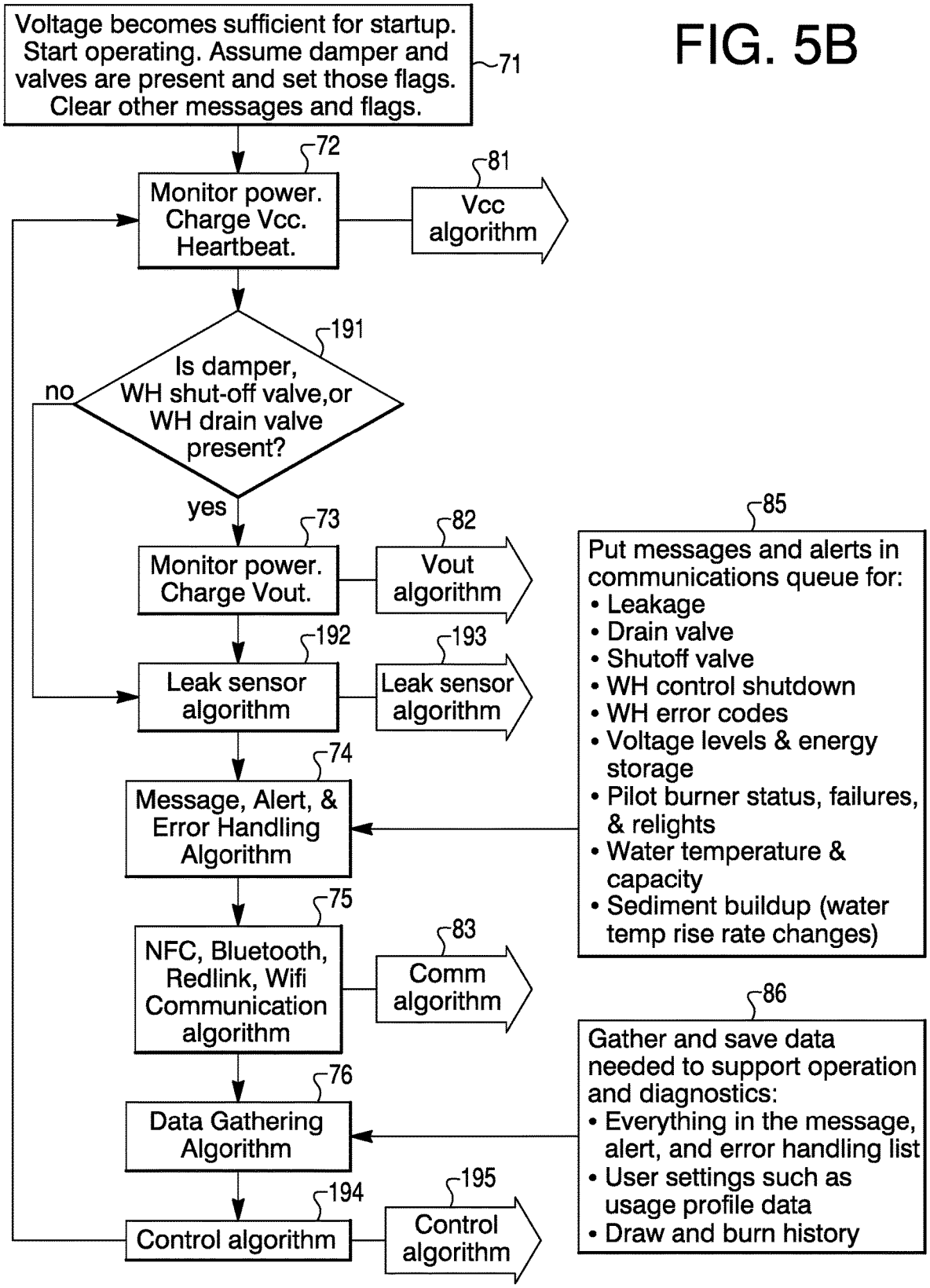
FIG. 5*b* may be similar to FIG. 5*a* but may incorporate some other features.

FIG. 5*b* may be similar to FIG. 5*a* but may further incorporate a symbol 191 connected to symbol 72 and symbol 73 that asks a question whether a damper, water heater shut-off valve, or drain valve is present. If an answer is yes, then one may go to symbol 73 and then from symbol 73 to a symbol 192 for a leak sensor algorithm. If the answer is no to the question in symbol 191, then one may go directly to symbol 192 and leak sensor algorithm 193. From symbol 192, one may go to symbol 74. Information from block 85 to symbol 74 may further incorporate that of leakage, a drain valve and a shut-off valve. Information from block 86 to symbol 76 may further incorporate user settings such as usage profile data.

After symbol 76, a symbol 194 for a control algorithm may be placed in lieu of a pilot relight algorithm at symbol 77 and symbol 84. Control algorithm may be indicated by symbol 195. From symbol 194, one may go to symbol 72.

Figure 6A:
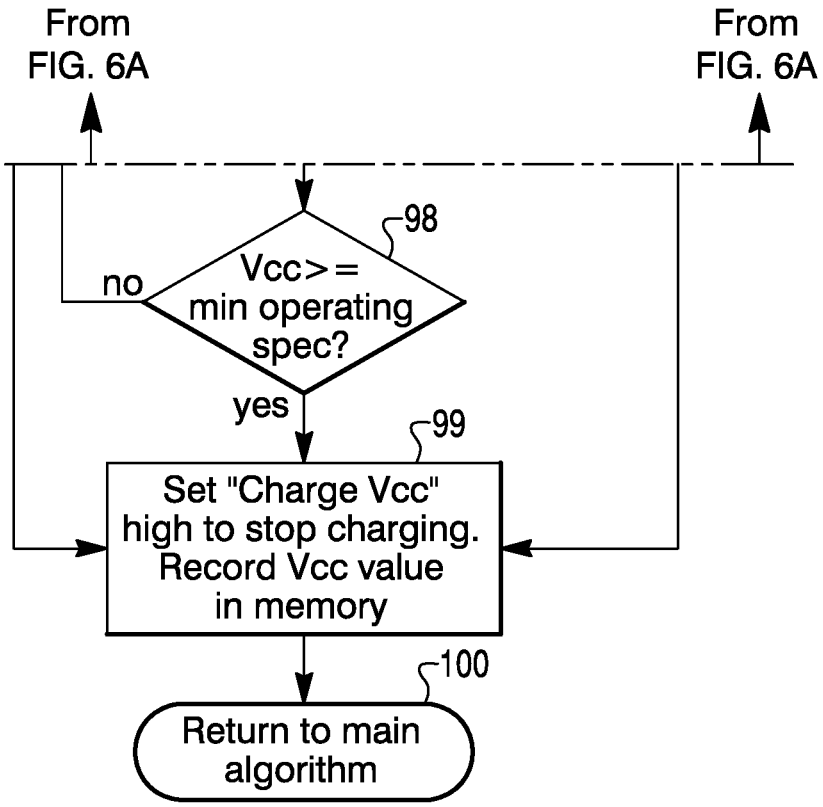
FIG. 6*a* is a flow diagram for a voltage algorithm.

FIG. 6*a* is a flow diagram for Vcc algorithm 81. At symbol 91, Vcc may be measured on an A/D line. A question at symbol 92 may be whether Vcc is greater than or equal to the maximum operating spec. If the answer is yes, then on may go to symbol 99 where "Charge Vcc" is set to high to stop charging. The Vcc value may be recorded in a memory. Then at symbol 100, a return to the main algorithm may be performed.

If Vcc is not greater than or equal to the maximum operating spec, then a thermopile voltage, Vth, may be read over (Vesta) communication RS232 at symbol 93. A question of whether Vth is greater than or equal to the charge Vcc may be asked at symbol 94. If the answer is yes, and then the pilot had failed earlier, then a successful relight may be flagged at symbol 95. At symbol 96, "Charge Vcc" may be set low to charge the Vcc capacitor and/or a battery. Then Vcc may be measured on A/D at symbol 97. A question of whether Vcc is greater than or equal to a minimum operating spec may be asked at symbol 98. If the answer is yes then "Charge Vcc" may be set to "high" to stop the charging. Also, the Vcc value may be recorded in a memory according to symbol 99. After symbol 99, a return may be made to the main algorithm as indicated in symbol 100.

If the answer is no to the question in symbol 98, then a return to symbol 91 may be made and the items at symbols 91-98 may be repeated with an answer to the questions at symbols 92 and 94 being no and yes, respectively. The question at symbol 98 may be answered as no. Then a question at symbol 101 may be whether Vcc is greater than or equal to a minimum operating spec. If the answer is yes, then "Charge Vcc" may be set to "high" to stop charging. The Vcc value may be recorded in the memory. A return to the main algorithm may occur at symbol 100.

If the answer is no to the question in symbol 101, then a question in symbol 102 whether Vcc is greater than or equal to a stay alive spec may be asked. If the answer is yes, then at symbol 103, "Charge Vcc" may be set high to stop the charging. Low power standby for xx seconds may occur. Then the sequence may continue from symbol 93 as noted herein.

If the answer to the question at symbol 102 is no, then at symbol 104, the thermopile voltage, Vth, may be read over a (Vesta) communications RS232. At symbol 105, a question of whether Vth is greater than or equal to than the stay alive spec may be asked. If the answer is no, then pilot failure may be flagged at symbol 106, and a return to symbol 103 may be made. The sequence from symbol 103 may occur as indicated herein.

If the answer at symbol 105 is yes, then "Charge Vcc" may be set to "low" to charge the Vcc capacitor and/or battery as indicated at symbol 107. Then a return to symbol 104 may occur and the sequence there may continue as indicated herein. The stay alive voltages should be somewhat above the voltages that will kill the controller in order to allow the algorithm to continue. The voltages may be a minimum voltage needed to stay alive plus run the algorithm.

Figure 6B:
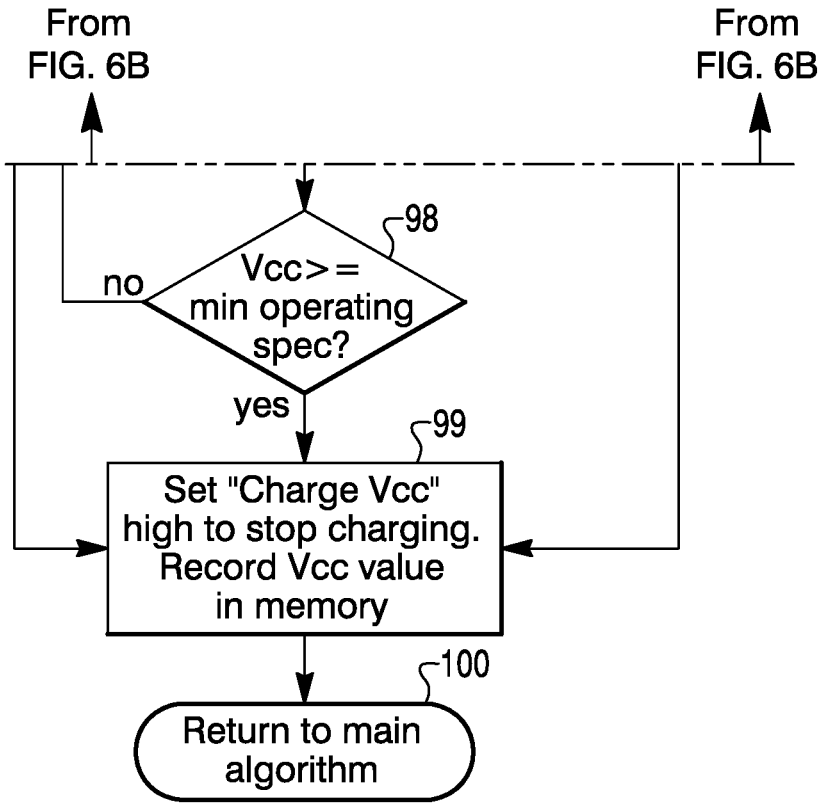
FIG. 6*b* may be similar to FIG. 6*a* for the voltage algorithm but may further incorporate some other features.

FIG. 6*b* may be similar to FIG. 6*a* for Vcc algorithm 81 but may further incorporate symbol 197 and symbol 198 in lieu of a direct connection from symbol 106. From symbol 106, one may go to symbol 197 that asks a question whether a pilot relight feature is present. If answer is no, then one may go to symbol 103. If the answer is yes, then one may go to symbol 198 that indicates a pilot relight procedure is to be performed. After symbol 198, one may go to symbol 103.

Figure 7:
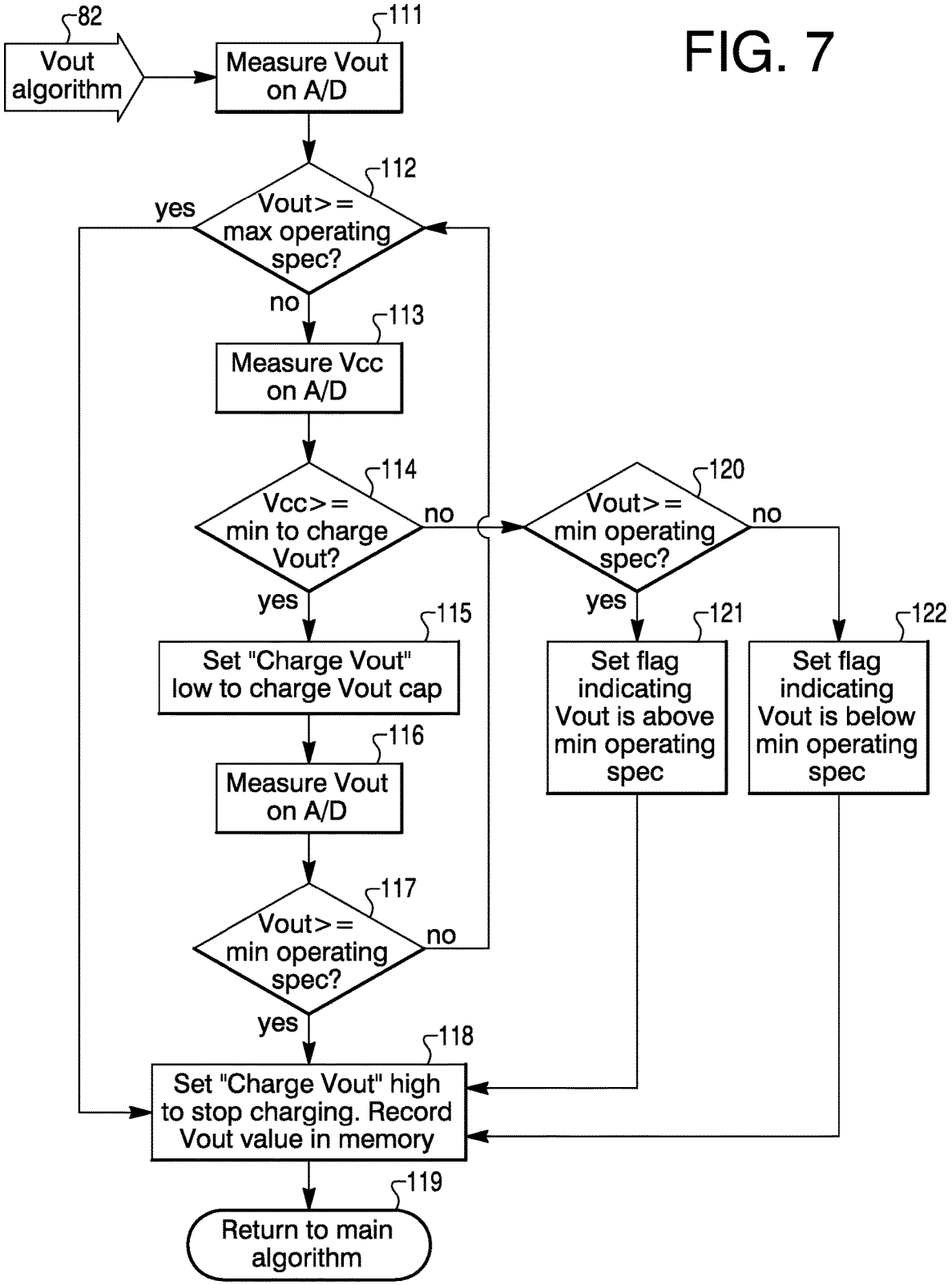
FIG. 7 is a flow diagram of another voltage algorithm.

A Vout algorithm 82 of FIG. 7 may begin at symbol 111 where a Vout on A/D may be measured. At symbol 112, a question of whether Vout is greater than or equal to the maximum operating spec may be asked. If the answer is yes, then at symbol 118, "Charge Vout" may be set to "high" to stop charging. The Vout value may be recorded in the memory, and a return to the main algorithm may occur at symbol 119.

If the answer to the question at symbol 112 is no, then Vcc may be measured on the A/D at symbol 113. A question of whether Vcc is greater than or equal to a minimum to charge Vout may be asked at symbol 114. If the answer is yes, then symbol 115 "Charge Vout" may be set to "low" to charge the Vout capacitor. Then Vout on the A/D may be measured at symbol 116. At symbol 117, a question of whether Vout is greater than or equal to the minimum operating spec may be asked. If the answer is yes, then the "Charge Vout" may be set to "high" to stop the charging, at symbol 118. Vout may be recorded in the memory. A return may then be made at symbol 119 to return to the main algorithm.

If the answer is no to the question at symbol 117, then a return may be made to symbol 112 where the question of whether Vout is greater than or equal to the maximum operating spec. The sequence after symbol 112 may followed as indicated herein.

If the answer to the question at symbol 114 is no, then a question of whether Vout is greater than or equal to the operating spec may be asked at symbol 120. If the answer is yes, then a flag may be set indicating that Vout is above the minimum operating spec according to symbol 121. Then at symbol 118, "Charge Vout" may be set to "high" to stop the charging. The Vout value may be recorded in the memory. If the answer is no, then a flag may be set indicating that Vout is below the minimum operating spec according to symbol 122. Then at symbol 118, the activity as indicated herein may occur.

Figure 8:
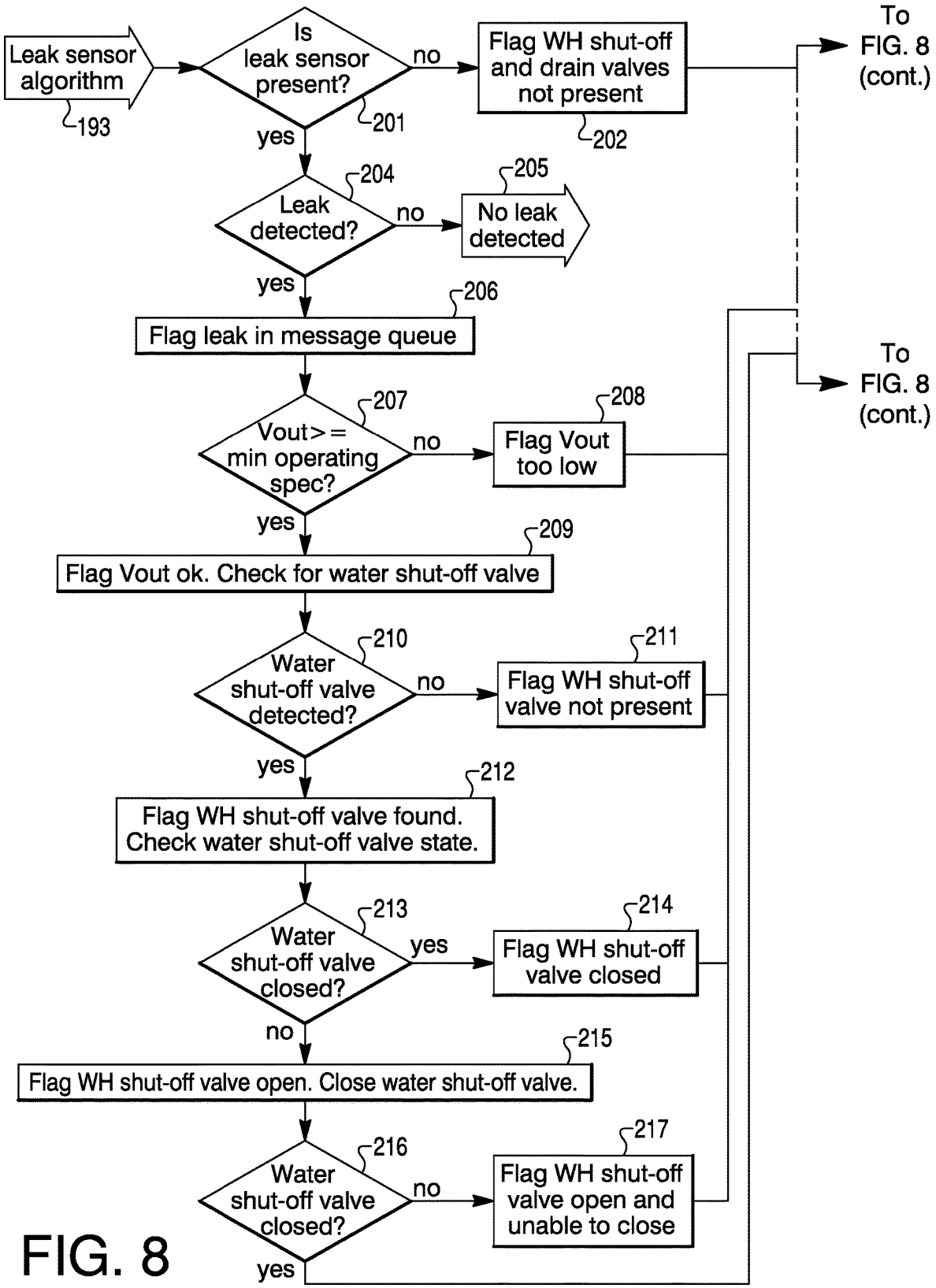
FIG. 8 is a flow diagram of leak sensor algorithm.
Figure 8:
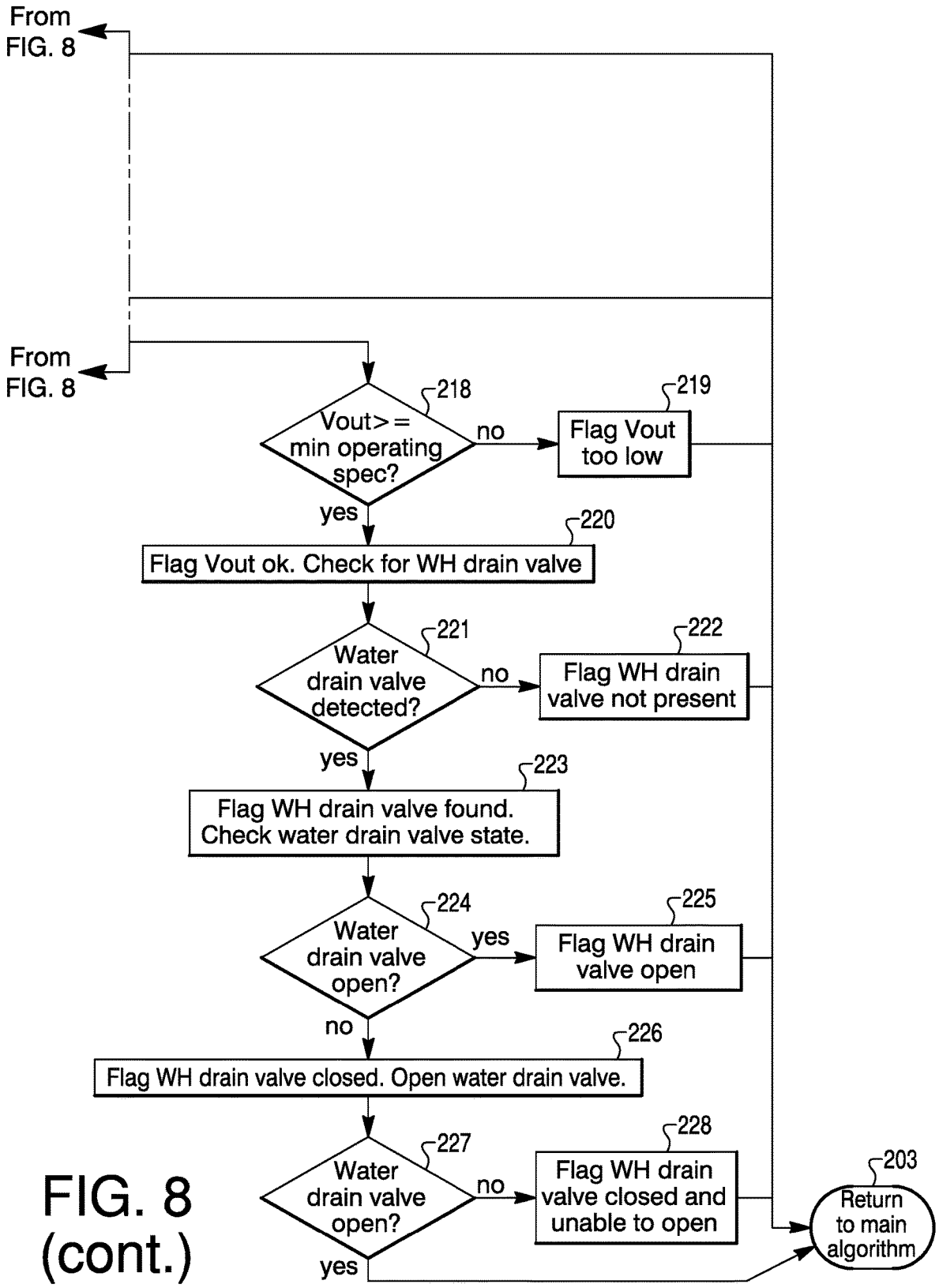

FIG. 8 is a flow diagram of leak sensor algorithm 193 that may start out with a symbol 201 asking a question whether a leak sensor is present. If not, then water heater shut-off and drain valves are flagged as not present according to symbol 202, and a return to a main algorithm may be made at symbol 203. If the answer at symbol 201 is yes, then a question of whether a leak is detected may be asked at symbol 204. If an answer is no, then no leak detected may be indicated at symbol 205. If the answer is yes, then the leak may be flagged in a message queue at symbol 206. After symbol 206, a question whether Vout>=minimum operating spec may be asked at symbol 207. If an answer is no, then flag Vout may be too low at symbol 208 and then a return to the main algorithm may be made as indicated by symbol 203.

If the answer to the question at symbol 207 is yes, then the flag Vout may be fine and the water shut-off valve may be checked for at symbol 209. A question of whether the water shut-off valve was detected may be asked at symbol 210. If an answer is no, then the water heater shut-off valve may be flagged at symbol 211 as not being present. After symbol 211, a return to the main algorithm may be made at symbol 203.

If the answer to the question at symbol 210 is yes, then at symbol 212, the water heater shut-off valve may be found and its state be checked. At symbol 213, a question of whether the water heater shut-off valve is closed may be asked. If an answer is yes, then the closure of the water heater valve may be flagged at symbol 214 after which a return to the main algorithm may be made as indicated by symbol 203. If the answer is no, then the water heater valve may be flagged as open and the valve may be closed at symbol 215. At symbol 216, a question of whether the shut-off valve is closed may be asked. If an answer is no, then the shut-off valve may be flagged as open and unable to be closed. Then at symbol 203, a return to the main algorithm may be made.

If the answer is yes to the question at symbol 216, then a question of whether Vout>=minimum operating spec may be asked. If an answer is no, then Vout as too low may be flagged at symbol 219 and a return to the main algorithm may be made according to symbol 203.

If the answer to the question at symbol 218 is yes, then Vout may be flagged as ok and the water heater drain valve may be checked at symbol 220. At symbol 221, a question of whether the water heater drain valve can be detected may be asked. If an answer is no, then the drain valve may be flagged as not being present at symbol 222 and a return to the main algorithm may be made as indicated at symbol 203. If the answer to the question is yes, then that the drain valve was found and the drain valve state is checked may be indicated at symbol 223.

At symbol 224, a question of whether the water heater drain valve is open may be asked at symbol 224. If an answer is yes, then that the drain valve is open may be flagged at symbol 225 and a return to the main algorithm may be made according to symbol 203. If the answer is no, then that the drain valve is closed may be flagged and the drain valve may be opened at symbol 226.

At symbol 227, a question of whether the drain valve is open may be asked. If an answer is no, then that the drain valve is closed and unable to be opened may be flagged at symbol 228, and a return to the main algorithm may be made as indicated at symbol 203. If the answer is yes, then a return to the main algorithm may occur according to symbol 203.

Figure 9:
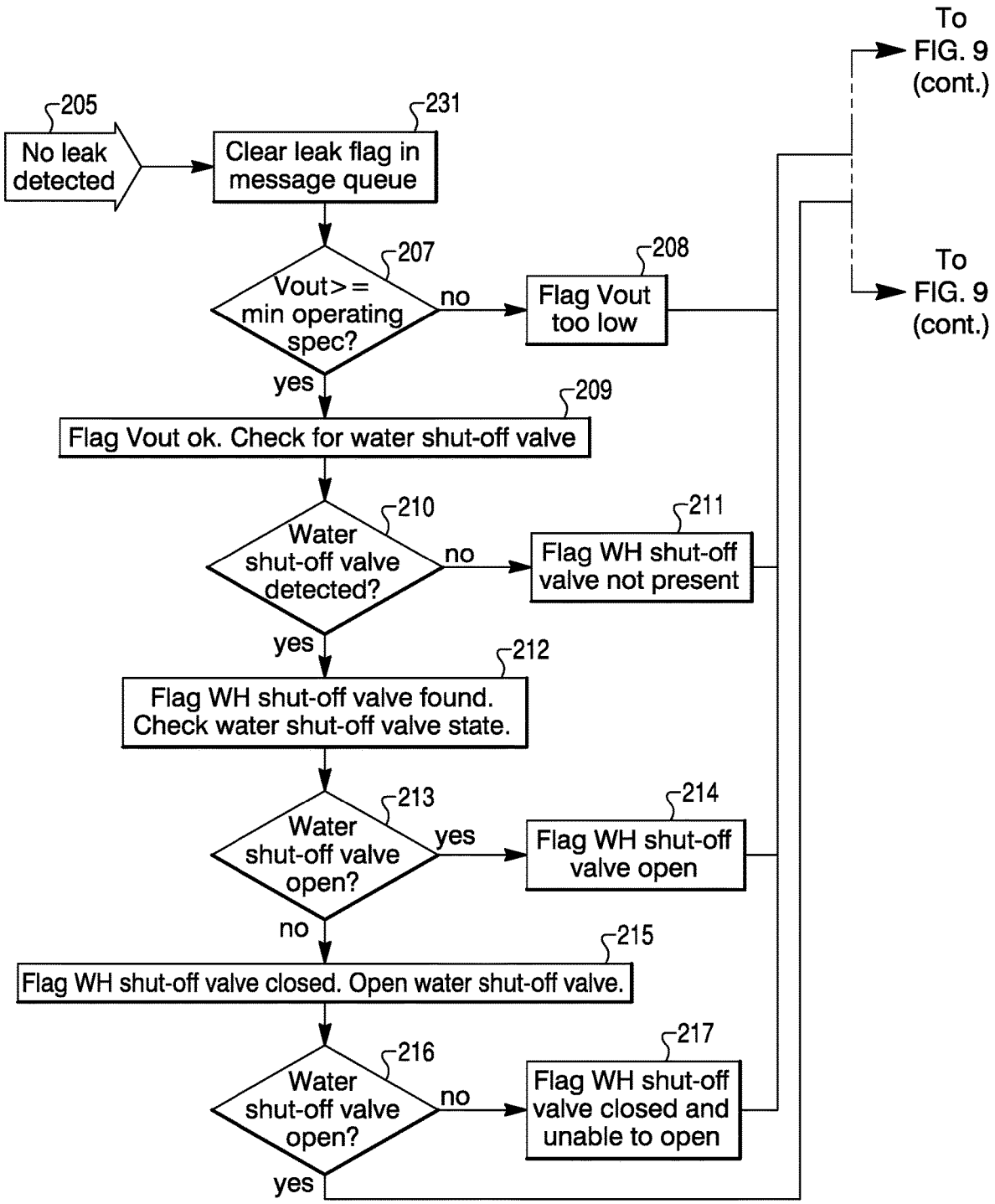
FIG. 9 is a flow diagram of a no leak detected algorithm.
Figure 9:
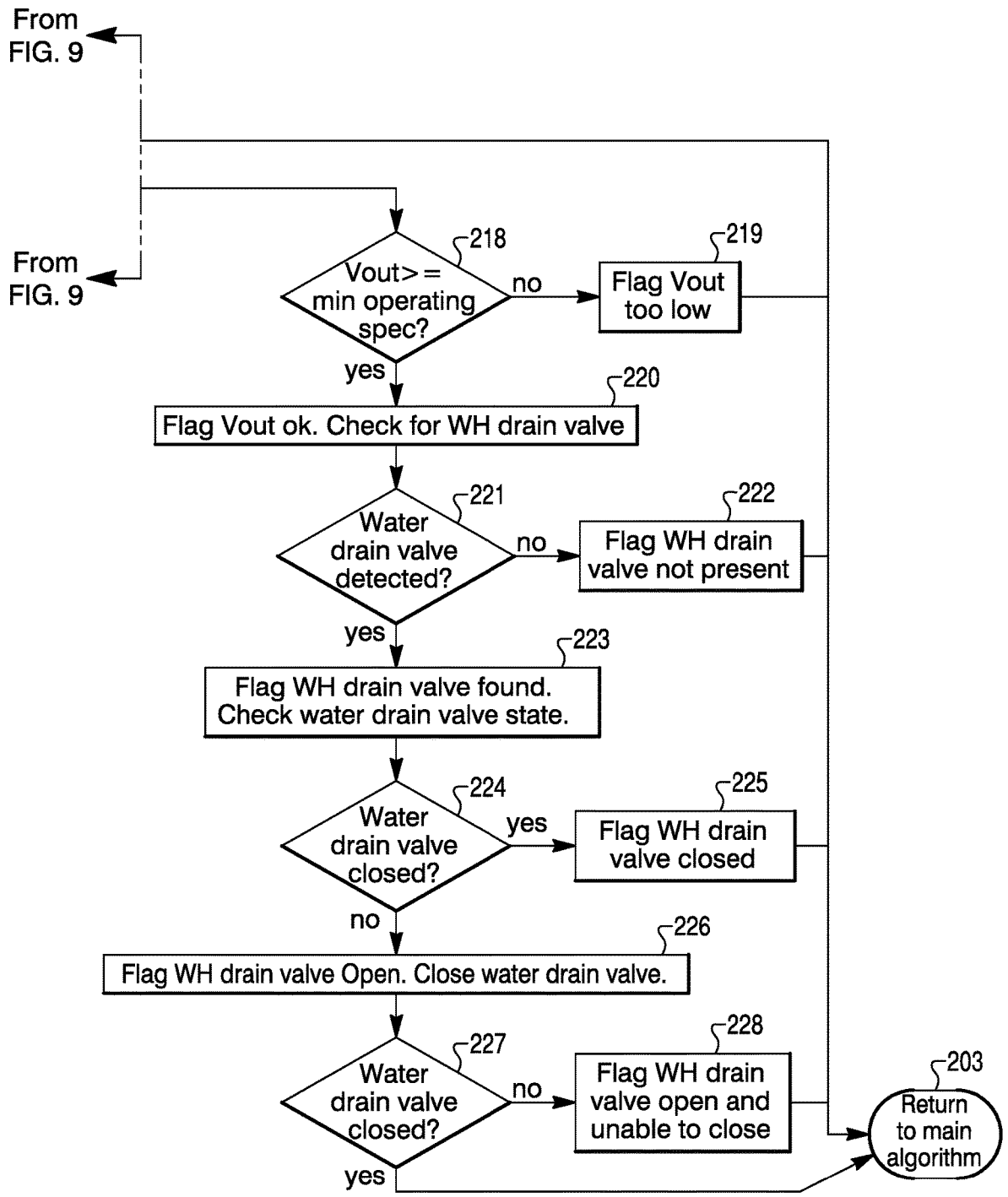

FIG. 9 is a flow diagram of a no leak detected algorithm of symbol 205. A clear leak flag in a message may be indicated in symbol 231. At symbol 207, a question of whether Vout>=minimum operating spec may be asked. For symbols 208 through 228 and including symbol 203, the items, steps and/or actions represented by these symbols are indicated in a description of the flow diagram in FIG. 8.

Figure 10:
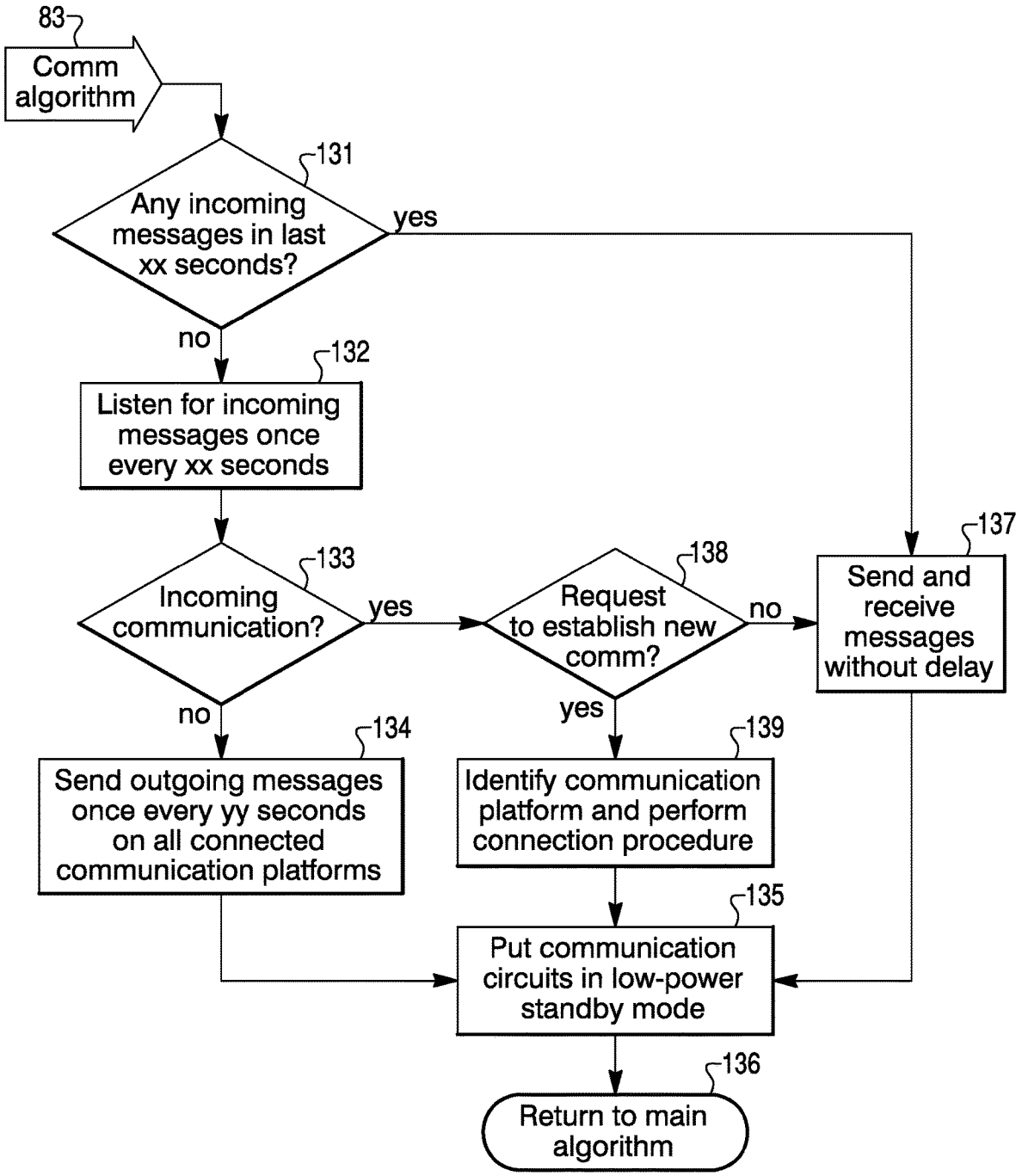
FIG. 10 is a flow diagram of a communications algorithm.

The communications algorithm 83 of FIG. 10 may begin with a question at symbol 131 whether there were any incoming messages in the last xx seconds. If the answer is no, then at symbol 132 incoming messages may be listened for once every xx seconds. A question may be asked at symbol 133 as to whether there is an incoming communication. If the answer is no, then outgoing messages may be sent every yy seconds at symbol 134 on all connected communication platforms. At symbol 135, communication circuits may be put in a low-power standby mode. Then a return at symbol 136 may be made to the main algorithm. "xx" and "yy" may indicate predetermined periods of time. A point of the algorithm may be to check for and send messages periodically at some time interval that will be conveniently short to users but long enough to minimize power consumption.

If the answer to the question at symbol 131 is yes, then messages may be sent and received without delay at symbol 137. Afterwards, communication circuits may be put in low power standby mode in symbol 135 and a return may be made to the main algorithm according to symbol 136.

If the answer to the question at symbol 133 is yes, then a question of whether there is a request to establish a communication may be asked at symbol 138. If the answer to the question at symbol 138 is no, then messages may be sent and received without delay at symbol 137. The sequence of activity that follows symbol 137 may be indicated herein.

If the answer to the question at symbol 138 is yes, then a communication platform may be identified and a connection procedure may be performed as indicated at symbol 139. The sequence of activity after symbol 139 noted at symbol 135 may be indicated herein.

Other than for a setup, messages may be generally outgoing only, so wait time is not necessarily a major issue. Thus, messages may be sent at a relatively long time interval in contrast to an average interval without an issue. The point of the algorithm may be to check for and send messages periodically at some time interval that will be conveniently short to users but long enough to minimize power consumption.

Figure 11:
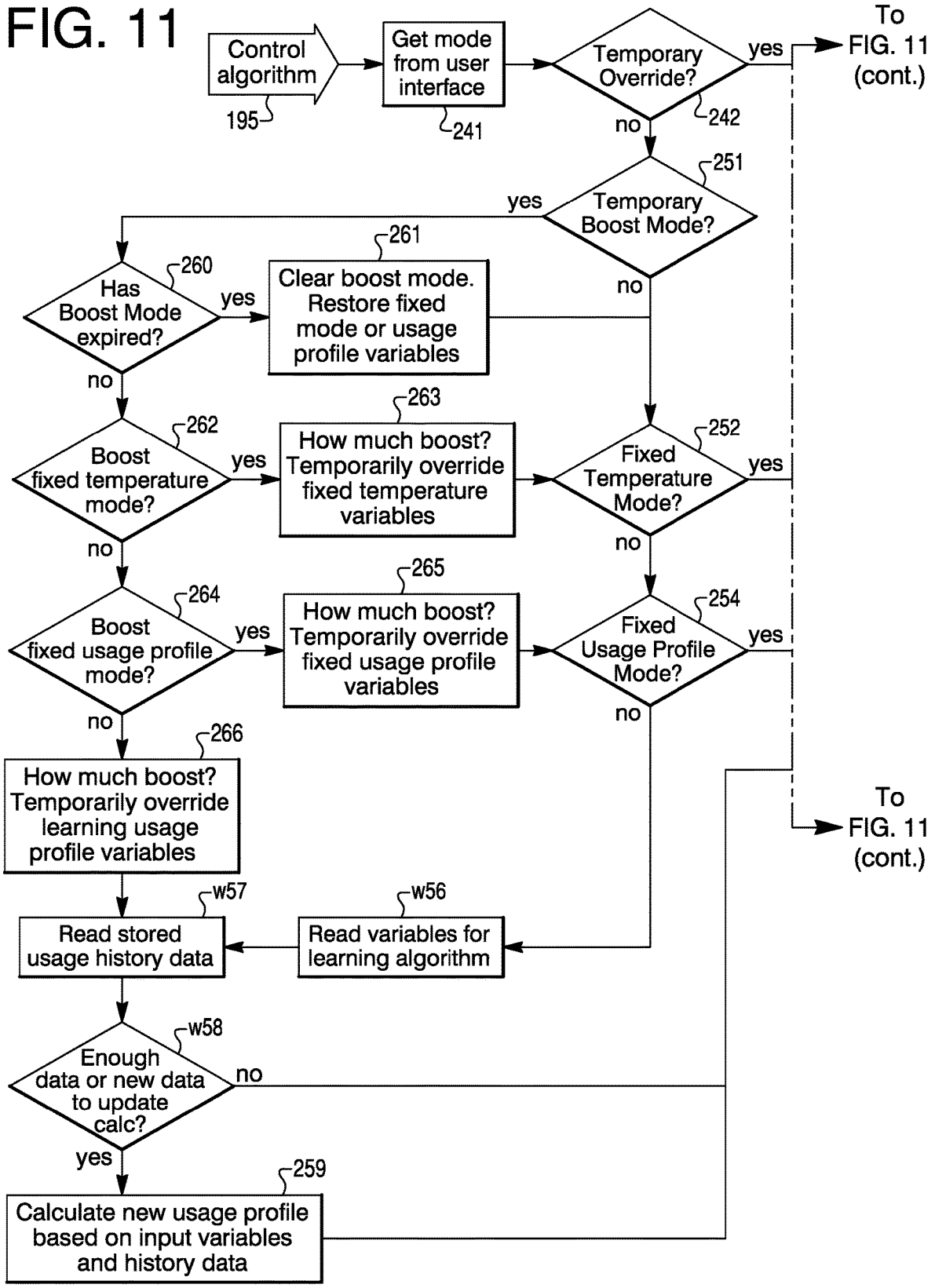
FIG. 11 is a flow diagram of a control algorithm.

FIG. 11 is a flow diagram of a control algorithm 195 where a mode from a user interface may be obtained as indicated in symbol 241. In symbol 242, a question of whether there is a temporary override may be asked. If an answer is yes, then fixed temperatures may be temporarily overridden at symbol 243. At symbol 244, a question of whether desired capacity>tank volume may be asked. If an answer is no, then a set point may be loaded into a message list, and an error message may be loaded if a desired setting is not possible according to symbol 245. After symbol 245, a return to the main algorithm may occur at symbol 246.

If the answer of the question at symbol 244 is yes, then a question at symbol 247 of whether an electronic mixing valve is installed may be asked. If an answer is no, then a higher set point to increase capacity may be calculated. Then at symbol 245, the set point may be loaded into a message list, and an error message may be loaded if a desired setting is not possible according to symbol 245. After symbol 245, a return to the main algorithm may occur according to symbol 246.

If the answer to the question at symbol 247 is yes, then a desired temperature may be loaded into a mixing valve message at symbol 249. Then a set point needed to achieve a desired capacity may be calculated according to symbol 250. The set point may be loaded into the message list, or an error message may be loaded if a desired setting is not possible. Then a return to the main algorithm may occur at symbol 246.

If the answer to the question at symbol 242 is no, then a question of whether there is a temporary boost mode may be asked at symbol 251. If an answer is no, then a question of whether there is a fixed temperature mode may be asked. If an answer is yes, then at symbol 253, a fixed capacity and temperature data may be read. Subsequent to symbol 253, items of symbols 244 through 250 may occur.

If the answer to the question at symbol 252 is no, then a question of whether there is a fixed usage profile mode may be asked at symbol 254. If an answer is yes, then capacity and temperature data for a current day of a week and time of day may be read at symbol 255. Subsequent to symbol 255, items of symbols 244 through 250 may occur.

If the answer to the question at symbol 254 is no, then learning variables for a learning algorithm may be read according to symbol 256 and stored usage history data may be read at symbol 257. A question of whether there is enough data or new data to update a calculation may be asked at symbol 258. If an answer is no, then items of symbols 255, and 244 through 250 may occur. If the answer is yes to the question of symbol 258, then a new usage profile based on input variables and history data may be calculated. Then items of symbols 255, and 244 through 250 may occur.

If the answer to the question at symbol 251 is yes, then a question of whether the boost mode has expired may be asked at symbol 260. If an answer is yes, then the boost mode may be cleared and the fixed mode or usage profile variables may be restored according to symbol 261. Subsequent to symbol 261, items of symbols 252, 253, and 244 through 250 may occur.

If the answer to the question at symbol 260 is no, then a question of whether a fixed temperature mode is boosted may be asked at symbol 262. If an answer is yes, then a question of how much boost may be asked and fixed temperature variables may be temporarily overridden. Subsequent to symbol 263, items of symbols 252, 253, and 244 through 250 may occur.

If the answer to the question at symbol 262 is no, then a question of whether to boost a fixed usage profile mode may be asked at symbol 264. If an answer is yes, then a question of how much boost may be asked and fixed usage profile variables may be temporarily overridden at symbol 265. Subsequent to symbol 265, items of symbols 254, 255, 244 through 250, and 256 through 259 may occur.

If the answer to the question at symbol 264 is no, then a question of how much boost may be asked and learning usage profile variables may be temporarily overridden at symbol 266. Subsequent to symbol 266, items at symbols 257 through 259, 255, and 244 through 250 may occur.

Figure 12:
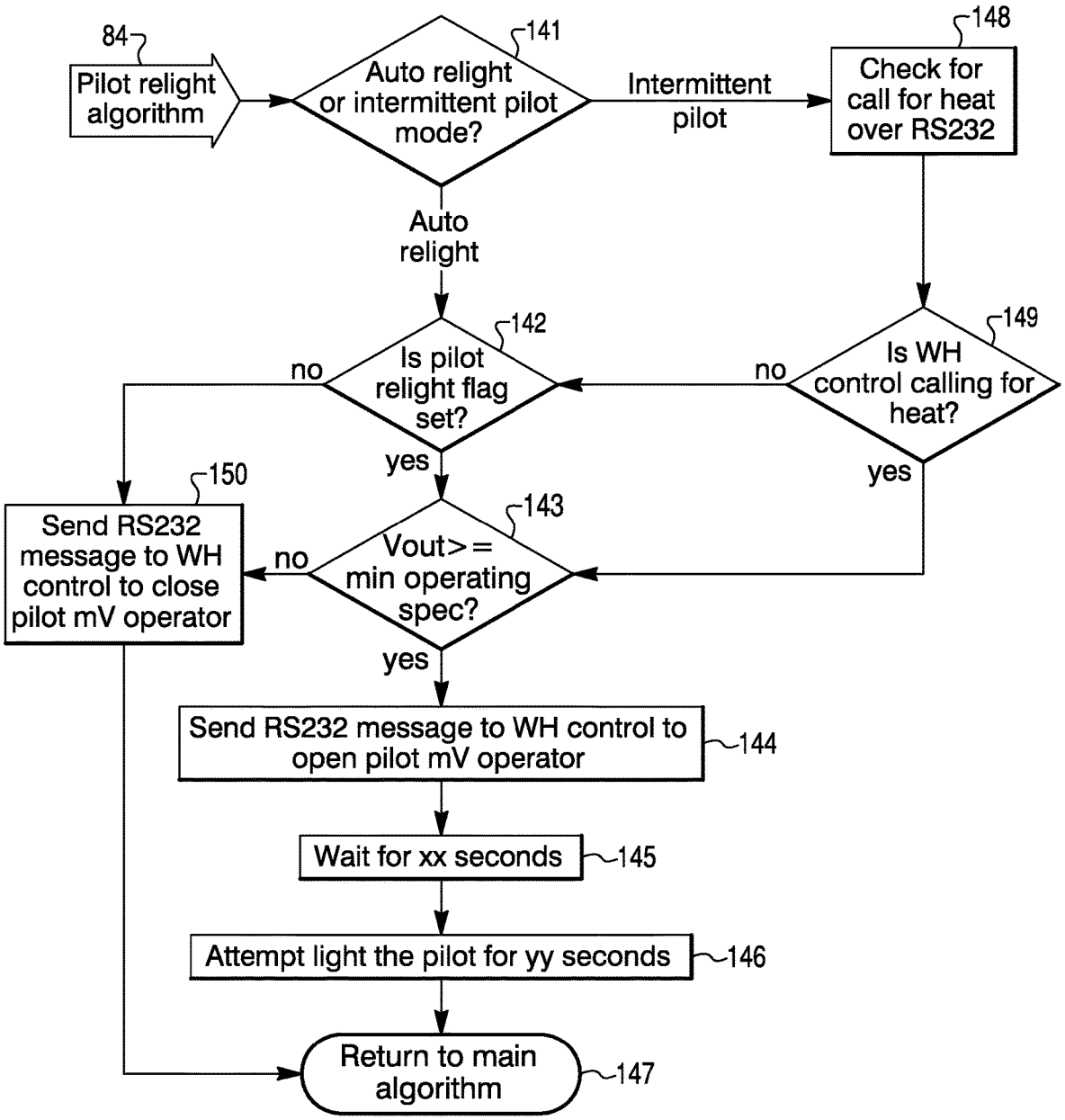
FIG. 12 is a flow diagram of a pilot relight algorithm.

The pilot relight algorithm 84 of FIG. 12 may begin at symbol 141 where a question of whether there is an auto relight or intermittent pilot mode. If the mode is auto relight, then a question whether a pilot relight is set or not set may be asked at symbol 142. If the answer is yes, then a question of whether Vout is greater than or equal to a minimum operating voltage as indicated in symbol 143. If the answer is yes, then a RS232 message may be sent to a water heater control to open a pilot mV operator as indicated by symbol 144. A response to the message may be waited for, for xx seconds at symbol 145. An attempt to light the pilot may occur for yy seconds at symbol 146. Then at symbol 147, a return to the main algorithm may occur.

If an answer to the question in symbol 141 is an intermittent pilot, then a check for a call for heat over the RS232 may be made at symbol 148. A question whether the water heater control is calling for heat over the RS232 may be asked at symbol 149. If an answer to the question is no, then the question at symbol 142 whether the pilot relight flag is set may be asked. If the answer is no, then an RS232 message may be sent to the water heater control to close the pilot mV operator at a symbol 150. After symbol 150, a return to the main algorithm may be made according to symbol 147.

If the answer to the question in symbol 149 is yes, then the question of whether Vout is greater than or equal to a minimum operating spec may be asked at symbol 143. The activity sequence for the yes and no answers relative to the question at symbol 143 may be indicated herein.

Additional items may be noted. In a usage mode setup, there may be setup screens for boost, manual override, vacation, fixed temperature, fixed usage pattern, and learning usage pattern operating modes. One may show an estimated energy and money savings based on the usage mode setup. Options may include detection of whether people are home and make hot water available. There may be an option to stay in a standby mode if no one is home. One may work off phones, Wi-Fi activity, connected home information, and so forth. There may be an option to have a specified amount of extra hot water available beyond what the usage profile determines is needed. If the pilot relight feature is included in a module, one may choose automatic pilot relight or intermittent pilot.

In a system setup, an application may include setup instructions, links to help, videos, and so on. There may be a setup screen for a communication arrangement.

There may be setup screens for appliance data. They may include options to select a water heater model, dish washer model and clothes washer model. An option may allow one to manually enter the data or to estimate the data. Data options may include fuel type, fuel cost, BTU/hr, WH gallon capacity, how much water dish washer or clothes washer consume, shower head flow rate, and so forth. Energy/money saving suggestions and options may allow one to easily or automatically change the setup or user profile based on suggestions. If electronic mixing valve is present, the user may be shown the capacity increase that is available as a function of temperature. There may be a setup for integration into any connected home/smart home systems.

A message and alert setup may have a setup screen for users to select what message and alerts they would like to receive and how they would like to receive them. There may be set up options to alert service providers. Possible messages may include any warnings, system errors, abnormal water usage, hot water capacity, leaks, pilot failures and relights, energy storage, energy and money savings from the usage profile vs having a fixed temperature, and so on.

The phone or computer app may contain most of the data analysis or processor intensive calculations. The device on the water heater may do only what is necessary for its normal operation. Data analysis may be done in the phone or computer using data gathered and logged in the device mounted on the water heater. Results may be stored in a cloud location.

Usage profiles may include setting minimum water temperatures for the times when hot water is not needed. Usage profiles may be broken down into convenient time intervals such as 30 minutes or user definable blocks of time. Before any usage history is collected, the starting point may be a fixed usage profile or a fixed temp, depending on what the user enters. The nature of statistics may change the results/accuracy of the learned usage profile based on the amount of data available. One may calculate the times, temperature, and capacity needed to a specified confidence level based on max temperature desired, burn times, and max water temp rise rate or BTU rate.

For learned usage profiles, more confidence may increase hot water schedule and cost. Less confidence may reduce hot water schedule and cost. One may include capability to heat using the pilot if there's a long time between times when hot water is needed.

Water heater Vcc (thermopile) may be monitored to detect if pilot goes out. A message may be sent out to the user which includes information on how much hot water is available. A periodic RS232 comm may be sent out to ensure control is still alive.

A pilot function may incorporate an intermittent pilot, or relight the pilot, and an option to keep the water heater control alive if the pilot goes out. It may be kept alive by applying Vcc back through RS232. A relight may include an intermittent pilot circuit in the control and plug the spark rod into the control and the piezo into the control. This may open the pilot valve by repowering the Vesta control and commanding the pilot open through comms. If the automatic relight fails, one may still use the piezo. The function may be in a stand-alone device that does not offer any comms, or be included in the present device.

There may be a learning algorithm option which would set a confidence level of having hot water vs energy savings. An option may result in hot water being available whenever the furnace thermostat is set for when people are home. One may heat water with the pilot when there is a long time between demand periods.

An option may be included for staying in a standby mode if no one is home. One may work off phones, Wi-Fi activity, connected home info, and so forth. Control of an electronic mixing valve may be included. The set point may be put to the lowest possible temperature to meet demand. A temperature profile may be monitored during burn to identify problems such as sediment buildup. Any controller error codes may be checked and the user may be alerted of any.

Learning software that saves energy may include software that automatically adjusts water heater temperature based on usage patterns. There may be daily, weekly, monthly, yearly (selectable) updates of energy consumption. There may be customizable alarms and alerts regarding energy consumption.

Errors and alerts may be in plain English, including troubleshooting tips, and recommended actions (excluding water heater leaks). There may be water heater leak alerts and alarms. There may be remote adjustment of water temperature, and enter and exit vacation modes. One may view available hot water. There may be a temporary boost mode for a longer supply of hot water. Paid remote monitoring by service provider/3rd party for quick service and problem resolution may be made available.

Symbols such as H, X, Y, xx, yy, and the like, may represent certain numerical values that might be predetermined.

To recap, a pilot lighting system may incorporate a processor, a pilot ignition circuit connected to the processor, a communications circuit connected to the processor, an energy storage circuit connected to the processor, the communications circuit and the pilot ignition circuit, and a source of energy connected the energy storage circuit.

The source of energy may incorporate a thermo power source. The thermo power source may be proximate to a pilot and generate power if the pilot has a flame. The communications circuit, energy storage circuit and the thermo power source may be connectable to an appliance controller. The appliance controller may control a fuel valve for the pilot. The appliance controller may be associated with an appliance.

The appliance may be a hot water heater.

If the pilot has no flame, no power is necessarily generated by the thermo power source for the processor and the energy storage circuit. Power may be provided from the energy storage circuit to the processor if sufficient energy is in the storage circuit for regular operation of the processor. The processor may provide a signal to the appliance controller to open the fuel valve for the pilot. If the fuel valve for the pilot is opened, then the processor may send a signal to the pilot ignition circuit to provide a spark at the pilot to ignite the pilot.

The pilot ignition circuit may provide a spark at the pilot every X seconds until the pilot lights up, or until Y seconds have passed after the spark has been first provided at the pilot if the pilot does not light up. After the Y seconds have passed, then a voltage of the communications circuit or the thermo power source may be checked. If the voltage of the communications circuit or the thermo power source is insufficient for regular operation, then relighting of the pilot may begin and continue until the energy in the energy storage circuit is depleted to a first amount.

If the communications circuit incorporates WiFi or other communicating capability, then when the energy in the energy storage circuit is depleted to the first amount, then the communications circuit may be revived and send a message indicating a failure to relight and an amount of hot water available in the appliance.

The first amount of energy in the energy storage circuit may be used to sound an alarm to alert a person in an area of the appliance that the pilot is extinguished and cannot be relit.

When a burn cycle of the appliance is complete, then the fuel valve for the pilot may be closed and the pilot be extinguished. When the pilot is extinguished, then the fuel valve for the pilot may be opened, the pilot may be lit and the pilot may heat the thermo power source to provide energy to the energy storage circuit without the burn cycle being run if an energy level in the energy storage circuit is below an H threshold level.

If the energy level in the energy storage circuit is equal to or greater than the H threshold level and the water temperature is below G degrees, then the burn cycle may operate and the thermo power source may provide energy to the energy storage circuit.

The source of energy may further incorporate one or more items selected from a group consisting of thermopiles, solar panels, wind generators, rechargeable batteries, and energy harvesting systems.

The communications circuit and the thermo power source may be connectable to one or more additional appliance controllers.

The ignition circuit may incorporate a standing pilot mode or an intermittent pilot mode. A pilot mode may be selectable from a smart device if the communications circuit incorporates a wireless or network capability.

An approach for lighting a pilot may incorporate providing a processor, connecting a pilot ignition circuit to the processor, connecting a communications circuit to the processor, connecting an energy storage circuit to the processor, the communications circuit and the pilot ignition circuit, and providing energy, from a thermoelectric device proximate to a pilot having a flame, to the energy storage circuit.

The communications circuit and the energy storage circuit may be connectable to an appliance controller. The appliance controller may control a fuel valve for the pilot. The appliance controller may be associated with an appliance.

Power may be provided from the energy storage circuit to the processor if sufficient energy is in the storage circuit for regular operation of the processor. The processor may provide a signal to the appliance controller to open the fuel valve for the pilot. If the fuel valve for the pilot is opened, then the processor may send a signal to the pilot ignition circuit to provide a spark at the pilot to ignite the pilot. If the voltage of the communications circuit or the thermoelectric device is insufficient for regular operation, then relighting of the pilot may begin and continue until the energy in the energy storage circuit is depleted to a first amount.

If the communications circuit incorporates WiFi or other communicating capability, then when the energy in the energy storage circuit is depleted to the first amount, then the communications circuit may be revived and send a message indicating a failure to relight and an amount of hot water available in the appliance. The first amount of energy in the energy storage circuit may be used to sound an alarm to alert a person in an area of the appliance that the pilot is extinguished and cannot be relit.

The appliance may be a hot water heater. The communications circuit and the thermoelectric device may be connectable to one or more additional appliance controllers.

A pilot lighting system may incorporate a processor, a communications circuit connected to the processor, a pilot ignition circuit connected to the processor, an energy source, and an energy storage circuit connected to the energy source, the processor, the communications circuit and the pilot ignition circuit.

The energy source may be proximate to a pilot and generate power if the pilot has a flame. The communications circuit and the energy source may be connectable to an appliance controller. The appliance controller and pilot may be associated with an appliance.

The processor may provide a signal to the appliance controller to open a fuel valve for the pilot and eventually, if the pilot is ignited by the pilot ignition circuit, a fuel valve for a main heater of the appliance may be opened.

The pilot ignition circuit may provide a spark at the pilot periodically until the pilot lights up, or until after a predetermined amount of time. If the voltage of the communications circuit or the energy source is insufficient for regular operation, then relighting of the pilot may begin and continue until the energy in the energy storage circuit is depleted to a first amount.

When a burn cycle of the main heater is run and complete, then the fuel valve for the pilot may be closed and the pilot may be extinguished. When the pilot is extinguished, then the fuel valve for the pilot may be opened, the pilot may be lit and the pilot may heat the energy source to provide energy to the energy storage circuit without the burn cycle being run if an energy level in the energy storage circuit is below a predetermined threshold level. If the energy level in the energy storage circuit is equal to or greater than the predetermined threshold level and the water temperature is below a predetermined temperature, then the burn cycle may operate and the energy source may provide energy to the energy storage circuit. The appliance may be a hot water heater.

In the present specification, some of the matter may be of a hypothetical or prophetic nature although stated in another manner or tense.

Although the present system and/or approach has been described with respect to at least one illustrative example, many variations and modifications will become apparent to those skilled in the art upon reading the specification. It is therefore the intention that the appended claims be interpreted as broadly as possible in view of the related art to include all such variations and modifications.

What is claimed is:

1. A pilot lighting system comprising:

a processor;

a pilot ignition circuit connected to the processor;

a communications circuit connected to the processor, the communications circuit operably coupled to a remote device via a wireless or wired connection and configured to transmit a message indicating an amount of hot water available in an appliance;

an energy storage circuit connected to the processor, the communications circuit and the pilot ignition circuit; and a source of energy connected to the energy storage circuit; and wherein:

the source of energy comprises a thermo power source;

the thermo power source is proximate to a pilot and generates power when the pilot has a flame;

the communications circuit, energy storage circuit and the thermo power source are connectable to an appliance controller;

the appliance controller controls a fuel valve for the pilot;

the appliance controller is associated with the appliance; and when the pilot is extinguished, then the fuel valve for the pilot is opened, the pilot is lit, and the pilot heats the thermo power source to provide energy to the energy storage circuit without a burn cycle being run if an energy level in the energy storage circuit is below a predetermined threshold level; and wherein the communications circuit is further configured to transmit a plain English error message related to the pilot and a plain English recommended action for remedying the error message, wherein the processor is configured to determine if the pilot is lit and, if not, attempt to relight the pilot by sending a signal to the pilot ignition circuit to provide a spark at the pilot to ignite the pilot, and wherein, after the attempt to relight the pilot fails and when the energy in the energy storage circuit is depleted to a first amount, then the communications circuit is configured to send a message to the remote device indicating a failure to relight.

2. The pilot lighting system of claim 1, wherein the appliance is a hot water heater.

3. The pilot lighting system of claim 1, wherein:

if the pilot has no flame, no power is generated by the thermo power source for the processor and the energy storage circuit;

power is provided from the energy storage circuit to the processor if sufficient energy is in the storage circuit for regular operation of the processor;

the processor can provide a signal to the appliance controller to open the fuel valve for the pilot; and if the fuel valve for the pilot is opened, then the processor sends the signal to the pilot ignition circuit to provide the spark at the pilot to ignite the pilot.

4. The pilot lighting system of claim 3, wherein:

the pilot ignition circuit provides the spark at the pilot every X seconds until the pilot lights up, or until Y seconds have passed after the spark has been first provided at the pilot if the pilot does not light up;

after the Y seconds have passed, then a voltage of the communications circuit or the thermo power source is checked; and if the voltage of the communications circuit or the thermo power source is insufficient for regular operation, then relighting of the pilot begins and continues until the energy in the energy storage circuit is depleted to the first amount.

5. The pilot lighting system of claim 4, when the energy in the energy storage circuit is depleted to the first amount, then the communications circuit is revived and sends the message indicating the failure to relight.

6. The pilot lighting system of claim 4, wherein the first amount of energy in the energy storage circuit is used to sound an alarm to alert a person in an area of the appliance that the pilot is extinguished and cannot be relit.

7. The pilot lighting system of claim 3, wherein when the burn cycle of the appliance is complete, then the fuel valve for the pilot is closed and the pilot is extinguished.

8. The pilot lighting system of claim 1, wherein if the energy level in the energy storage circuit is equal to or greater than the predetermined threshold level and the water temperature is below a predetermined temperature, then the burn cycle operates and the thermo power source provides energy to the energy storage circuit.

9. The pilot lighting system of claim 1, wherein the source of energy further comprises one or more items selected from a group consisting of thermopiles, solar panels, wind generators, rechargeable batteries, and energy harvesting systems.

10. The pilot lighting system of claim 1, wherein the communications circuit and the thermo power source are connectable to one or more additional appliance controllers.

11. The pilot lighting system of claim 1, wherein:

the ignition circuit comprises a standing pilot mode or an intermittent pilot mode; and a pilot mode is selectable from the remote device.

12. A pilot lighting system comprising:

a processor;

a communications circuit coupled to a remote device via a wireless or wired connection, the communications circuit connected to the processor;

a pilot ignition circuit connected to the processor;

an energy source; and an energy storage circuit connected to the energy source, the processor, the communications circuit and the pilot ignition circuit; and wherein:

the energy source is proximate to a pilot and generates power if the pilot has a flame;

the communications circuit and the energy source are connectable to an appliance controller;

the appliance controller and pilot are associated with an appliance; and when the pilot is extinguished, then the fuel valve for the pilot is opened, the pilot is lit and the pilot heats the thermo power source to provide energy to the energy storage circuit without a burn cycle being run if an energy level in the energy storage circuit is below a predetermined threshold level;

the communications circuit is configured to transmit a message to the remote device indicating an amount of hot water available in the appliance, the communications circuit is further configured to transmit an alphanumeric error message in plain English related to the pilot and an alphanumeric recommended action in plain English for the error message;

the processor is configured to determine if the pilot is lit and, if not, attempt to relight the pilot by sending a signal to the pilot ignition circuit to provide a spark at the pilot to ignite the pilot; and after the attempt to relight the pilot fails and when the energy in the energy storage circuit is depleted to a first amount, then the communications circuit is configured to send a message to the remote device indicating a failure to relight.

13. The pilot lighting system of claim 12, wherein the processor can provide a signal to the appliance controller to open a fuel valve for the pilot and eventually, if the pilot is ignited by the pilot ignition circuit, a fuel valve for a main heater of the appliance is opened.

14. The pilot lighting system of claim 13, wherein:

the pilot ignition circuit provides the spark at the pilot periodically until the pilot lights up, or until after a predetermined amount of time; and if the voltage of the communications circuit or the energy source is insufficient for regular operation, then relighting of the pilot begins and continues until the energy in the energy storage circuit is depleted to the first amount.

15. The pilot lighting system of claim 14, wherein:

when the burn cycle of the main heater is run and complete, then the fuel valve for the pilot is closed and the pilot is extinguished;

when the pilot is extinguished, then the fuel valve for the pilot is opened, the pilot is lit and the pilot heats the energy source to provide energy to the energy storage circuit without the burn cycle being run if an energy level in the energy storage circuit is below a predetermined threshold level;

if the energy level in the energy storage circuit is equal to or greater than the predetermined threshold level and the water temperature is below a predetermined temperature, then the burn cycle operates and the energy source provides energy to the energy storage circuit; and the appliance is a hot water heater.

16. A device for converting an appliance from a standing pilot mode to an intermittent pilot mode, wherein an existing appliance controller of the appliance controls a fuel valve for a pilot of the appliance in the standing pilot mode, the device comprising:

a processor;

a pilot ignition circuit connected to the processor;

a communications circuit connected to the processor, the communications circuit operably coupled to a remote device via a wireless connection and configured to transmit a message indicating an amount of hot water available in the appliance; and an energy storage circuit connected to the processor, the communications circuit, and the pilot ignition circuit, wherein the communications circuit and the energy storage circuit are connectable to the appliance controller, wherein the pilot ignition circuit is configured to control the pilot in the intermittent pilot mode by, when the pilot is extinguished, then the fuel valve for the pilot is opened, the pilot is lit, and the pilot heats a thermo power source to provide energy to the energy storage circuit without a burn cycle being run if an energy level in the energy storage circuit is below a predetermined threshold level, wherein the communications circuit is further configured to transmit a plain English error message related to the pilot and a plain English recommended action for remedying the error message, wherein the processor is configured to determine if the pilot is lit and, if not, attempt to relight the pilot by sending a signal to the pilot ignition circuit to provide a spark at the pilot to ignite the pilot, and wherein, after the attempt to relight the pilot fails and when the energy in the energy storage circuit is depleted to a first amount, then the communications circuit is configured to send a message to the remote device indicating a failure to relight.

17. The device of claim 16, further comprising a selector switch for changing between the standing pilot mode and the intermittent pilot mode.

18. The device of claim 16, wherein the communications circuit is configured to receive a second message from the remote device, and wherein the processor is configured to select between a standing pilot mode and an intermittent pilot mode based on contents of the second message.

* * * * *